US005510802A

United States Patent [19]

Tsuru et al.

[11] Patent Number: 5,510,802

[45] Date of Patent: Apr. 23, 1996

[54] SURFACE-MOUNTABLE ANTENNA UNIT

[75] Inventors: Teruhisa Tsuru; Hisatake Okamura; Harufumi Mandai; Mitsuhide Kato; Ken Tonegawa, all of Nagaokakyo, Japan

[73] Assignee: Murata Manufacturing Co., Ltd., Japan

[21] Appl. No.: 230,857

[22] Filed: Apr. 21, 1994

[30] Foreign Application Priority Data

| | | | |
|---|---|---|---|
| Apr. 23, 1993 | [JP] | Japan | 5-120552 |
| Feb. 14, 1994 | [JP] | Japan | 6-017490 |
| Feb. 24, 1994 | [JP] | Japan | 6-026843 |
| Feb. 25, 1994 | [JP] | Japan | 6-028159 |

[51] Int. Cl.[6] ..... H01Q 1/38

[52] U.S. Cl. ..... 343/700 MS; 343/846; 343/849

[58] Field of Search ..... 343/700 MS, 829, 343/846, 849

[56] References Cited

U.S. PATENT DOCUMENTS

| | | | |
|---|---|---|---|
| 4,218,682 | 8/1980 | Yu | 343/700 MS |
| 4,410,891 | 10/1983 | Schaubert et al. | 343/700 MS |
| 4,749,996 | 6/1988 | Tresselt | 343/829 |
| 4,806,941 | 2/1989 | Knochel et al. | 343/700 MS |
| 5,023,624 | 6/1991 | Heckaman et al. | 343/860 |
| 5,061,938 | 10/1991 | Zahn et al. | 343/846 |
| 5,291,210 | 3/1994 | Nakase | 343/700 MS |
| 5,319,378 | 6/1994 | Nalbandian et al. | 343/700 MS |

FOREIGN PATENT DOCUMENTS

| | | |
|---|---|---|
| 0366393 | 5/1990 | European Pat. Off. . |
| 0383292 | 8/1990 | European Pat. Off. . |
| 0526643 | 2/1993 | European Pat. Off. . |

OTHER PUBLICATIONS

Microstrip Antennas, I. J. Bahl, copyright 1980, pp. 26–29.

Small Antennas, K. Fujimoto et al., Copyright 1987, pp. 116–119, 147, 197–199.

*Primary Examiner*—Donald T. Hajec

*Assistant Examiner*—Tho Phan

*Attorney, Agent, or Firm*—Ostrolenk, Faber, Gerb & Soffen

[57] ABSTRACT

A surface-mountable antenna unit including a dielectric substrate having a rectangular plane shape which is provided on a side surface and/or a bottom surface thereof with a ground electrode, and a radiator, provided with a radiating part having a substantially rectangular plane shape, which is fixed to the dielectric substrate so that the radiator is opposed to a top surface of the dielectric substrate, with a feed part provided on a side surface of a laminate which is formed by the dielectric substrate and the radiator.

47 Claims, 24 Drawing Sheets

SURFACE-MOUNTABLE ANTENNA UNIT

BACKGROUND OF THE INVENTION

1. Field of the Invention

The present invention relates to an antenna unit which is surface-mountable on a circuit board or the like, and more particularly, it relates to a surface-mountable antenna unit which is preferably used in a mobile communication device or the like, for example.

2. Description of the Background Art

An antenna unit must be excellent in characteristics such as the gain and return loss, while further miniaturization is required for an antenna unit which is applied to a mobile communication device or the like.

In general, (a) an inverted-F antenna unit, (b) a microstrip antenna unit and (c) a dielectric-loaded monopole antenna unit are known to be those which are suitably used in high frequency ranges.

An example of the inverted-F antenna unit (a) is described in "Small Antennas" by K. Fujimoto, A. Henderson, K. Hirasawa and J. R. James, Research Studies Press Ltd., England. With reference to FIG. 1, an exemplary inverted-F antenna unit 1 is now described. The inverted-F antenna 1 has a rectangular metal plate 2 which serves as a radiating part. An edge of the metal plate 2 is partially perpendicularly bent to form a ground terminal 3. Another edge of the metal plate 2 is also partially bent to form a feed terminal 4.

Due to the aforementioned structure, it is possible to mount the inverted-F antenna 1 on a printed circuit board by inserting the ground terminal 3 and the feed terminal 4 in through holes which are provided in the printed circuit board.

In the inverted-F antenna 1, however, it is difficult to reduce the metal plate 2 in size due to an insufficient gain. Further, the printed circuit board for receiving the antenna 1 must be provided with through holes for receiving the ground terminal 3 and the feed terminal 4. In other words, it is impossible to surface-mount the inverted-F antenna 1 on the printed circuit board.

An example of the microstrip antenna unit (b) is described in "Microstrip Antennas" by I. J. Bahi and P. Bhartia, Artech House, for example. With reference to FIGS. 2A and 2B, an exemplary microstrip antenna unit 5 is now described. The microstrip antenna unit 5 comprises a dielectric substrate 6 having a rectangular plane shape. The dielectric substrate 6 is provided on its upper and lower surfaces with a radiating electrode 7 and a shield electrode 8 respectively. The shield electrode 8 is formed substantially over the lower surface of the dielectric substrate 6, excluding a portion to be connected with a coaxial cable and a connector 9. The connector 9 has an inner conductor which is electrically connected to a feeding point 7*a* of the radiating electrode 7 as shown in FIG. 2B, and an outer conductor which is electrically connected to the shield electrode 8.

The radiating electrode 7 receives/transmits electric waves, so that the microstrip antenna unit 5 operates as an antenna.

When the microstrip antenna unit 5 is miniaturized, however, its gain is disadvantageously reduced. Namely, the gain of the antenna unit 5 is inevitably reduced when the dielectric substrate 6 is reduced in size in order to attain miniaturization. In practice, therefore, the length of the radiating electrode 7, i.e., the size of its longer side cannot be reduced below 1/10 of the wavelength of the waves as transmitted/received, and hence the antenna unit 5 is restricted as to its potential for miniaturization.

Further, the antenna unit 5 cannot be surface-mounted on a printed board or the like since the connector 9 is provided on its bottom surface and projects therefrom. If the connector 9 is removed for enabling surface mounting, it is difficult to attain impedance matching between the antenna unit 5 and a circuit which is connected thereto, and hence its return loss is disadvantageously increased.

FIG. 3 shows an example of the dielectric-loaded monopole antenna unit (c). This monopole antenna unit 11 is fixed to a forward end of a coaxial connector 12. The antenna unit 11 comprises a cylindrical dielectric member 13, and electrode films are formed on an inner peripheral surface of a through hole 13*a* which is provided in the center of the dielectric member 13 and a forward end surface of the dielectric member 13, to define a radiating electrode. Namely, the dielectric member 13 is arranged around the radiating electrode.

While the antenna unit 11 can be miniaturized due to the aforementioned structure, its gain is still insufficient and the antenna unit 11 cannot be surface-mounted on a printed circuit board since the same is integrated with the coaxial connector 12.

SUMMARY OF THE INVENTION

In order to solve the aforementioned problems of the conventional high-frequency antenna units, an object of the present invention is to provide a surface-mountable antenna unit which can improve electric properties such as the gain and return loss, and is easy to miniaturize.

According to a wide aspect of the present invention, provided is a surface-mountable antenna unit comprising a dielectric substrate having a top surface, a bottom surface and side surfaces, a ground electrode which is formed at least one of the side surface and the bottom surface of the dielectric substrate, a radiator consisting of a material having low conductor loss which is fixed to the dielectric substrate so that its major surface is opposed to the top surface of the dielectric substrate, and a feed part which is provided on at least one of a side surface and a bottom surface of a laminate formed by the dielectric substrate and the radiator.

In the antenna unit according to the present invention, the ground electrode is arranged on the side or bottom surface and the feed part is arranged on the side surface, whereby a bottom surface of the laminate which is formed by the dielectric substrate and the radiator, i.e., a bottom surface of the dielectric substrate which is opposite to that provided with the radiator, can define a mounting surface. Thus, it is possible to provide an antenna unit which can be surface-mounted on a printed circuit board or the like.

Further, the radiator is made of a material having low conductor loss such as a metal plate, whereby the antenna unit is reduced in electrical resistance component and increased in thermal capacitance. Thus, joule loss is so reduced that it is possible to improve the gain of the antenna unit, thereby miniaturizing the same.

In addition, it is possible to easily attain impedance matching between the antenna unit and an external circuit by changing the distance between the feed part and the ground electrode thereby adjusting the inductance value therebetween, for reducing return loss.

The major surface of the radiator and the top surface of the dielectric substrate may be so opposed that these members are in close contact with each other. Alternatively, the major surface of the radiator may be opposed to the top surface of the dielectric substrate through a space of a prescribed thickness.

When the latter structure is employed so that a space of a prescribed thickness is defined between the major surface of the radiator and the top surface of the dielectric substrate, loss of radiated waves is suppressed by this space, whereby the gain of the antenna is further improved. Thus, the major surface of the radiator is preferably opposed to the top surface of the dielectric substrate through such a space.

In the structure provided with the space, a dielectric layer having a lower dielectric constant than the dielectric substrate may be further provided in this space.

It is further possible to arrange another circuit element such as a capacitor in this space, thereby speeding up miniaturization of the communication system.

In a specific aspect of the present invention, provided is a surface-mountable antenna unit in which the aforementioned radiator comprises a radiating part having the aforementioned major surface to be opposed to the dielectric substrate, and at least one fixed part extending from at least one edge of the radiating part toward the dielectric substrate. The at least one fixed part is fixed to a side surface of the dielectric substrate, so that the radiator is fixed to the dielectric substrate. According to this structure, the feed terminal and/or the ground terminal is integrally formed on a forward end of the fixed part. When the feed terminal and the ground terminal are thus integrally formed on the radiator, an inductance component is developed across these terminals. Thus, it is possible to change the inductance value of this inductance component by adjusting the distance between the ground terminal and the feed terminal or the like, to easily attain impedance matching between the antenna unit and an external circuit, thereby effectively reducing the return loss.

The antenna unit according to the present invention preferably further comprises space holding means for forming the space of a prescribed thickness between the major surface of the radiator and the top surface of the dielectric substrate. This space holding means can be formed by (a) stop members extending from the radiator toward the dielectric substrate to be in contact with the top surface of the dielectric substrate, or (b) projections which are formed on the top surface of the dielectric substrate to be in contact with the radiator.

In another specific aspect of the present invention, the radiator has a radiating part, an annular side wall part which is provided around the radiating part in the form of a closed ring, and a flange part which is provided on a forward end of the annular side wall part, and the flange part is mounted on the top surface of the dielectric substrate. In this case, the annular side wall part and the flange part serve also as the space holding means.

In still another specific aspect of the present invention, a capacitor is electrically connected between the ground electrode and the radiator. Thus, it is possible to reduce the resonance frequency of the antenna unit and to further miniaturize the same as clearly understood from embodiments described later.

In a further specific aspect of the present invention, other circuit elements are carried in or on the dielectric substrate. Particularly when the aforementioned space is formed between the radiator and the dielectric substrate, it is possible to carry such circuit elements in this space to form an antenna peripheral circuit in this antenna unit, thereby miniaturizing the overall apparatus including the antenna peripheral circuit.

The foregoing and other objects, features, aspects and advantages of the present invention will become more apparent from the following detailed description of the present invention when taken in conjunction with the accompanying drawings.

DETAILED DESCRIPTION OF CONCEPT OF INVENTIVE ANTENNA UNIT

Figure 1:
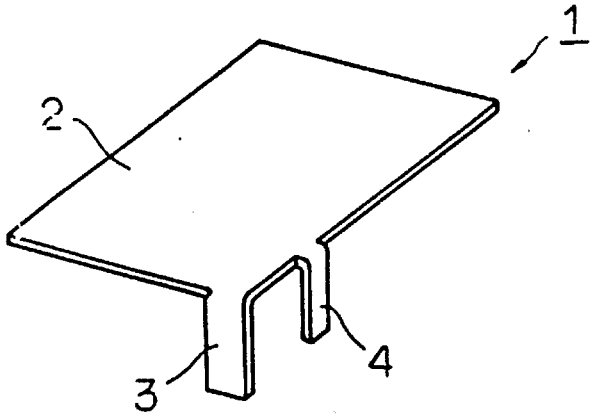
FIG. 1 PRIOR ART
FIG. 1 is a perspective view showing a conventional inverted-F antenna unit.
Figure 2A:
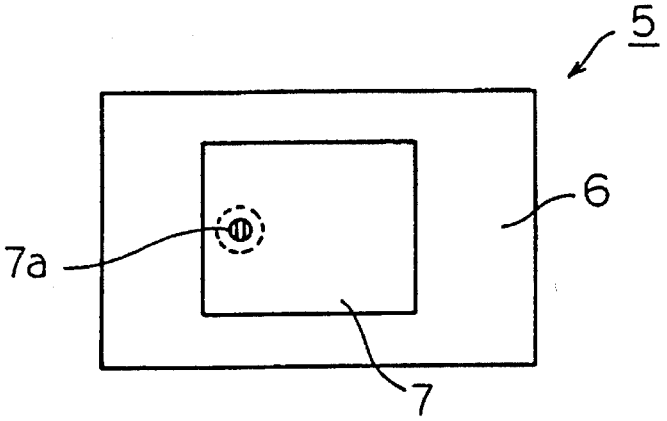
FIG. 2A PRIOR ART
FIGS. 2A and 2B are a plan view and a front sectional view showing a conventional microstrip antenna unit.
Figure 2B:
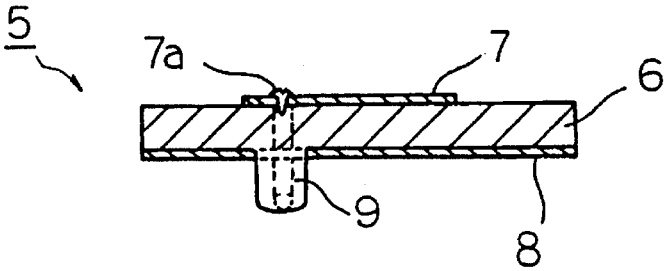
FIG. 2B PRIOR ART
Figure 3:
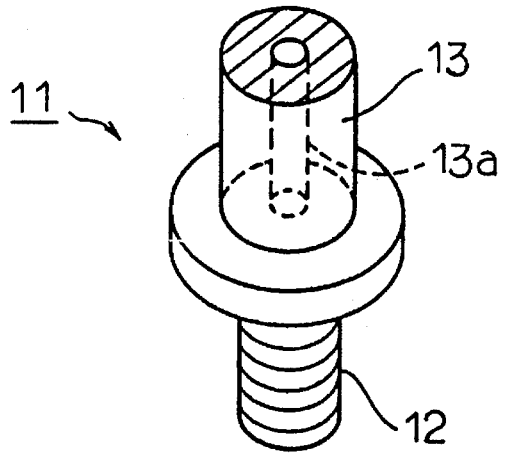
FIG. 3 PRIOR ART
FIG. 3 is a perspective view showing a conventional dielectric-loaded monopole antenna unit.
Figure 4:
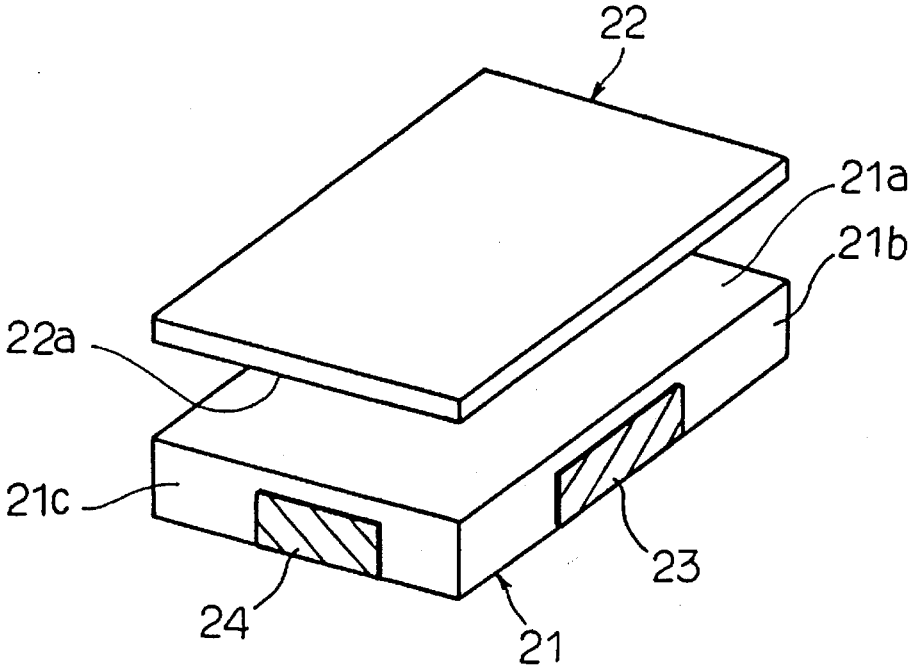
FIG. 4 is a perspective view for illustrating the concept of an antenna unit according to the present invention.

With reference to FIG. 4, the concept of the present invention is now described.

FIG. 4 is a perspective view for illustrating the concept of the antenna unit according to the present invention. It is pointed out that FIG. 4 is merely adapted to illustrate the concept of the present invention, and shapes of independent members and parts appearing in the following description are not restricted to those shown in FIG. 4.

The antenna unit according to the present invention is provided with a dielectric substrate 21, and a radiator 22 which is arranged so that its major surface 22*a* is opposed to a top surface 21*a* of the dielectric substrate 21.

While the major surface 22*a* of the radiator 22 is separated from the top surface 21*a* of the dielectric substrate 21 in FIG. 4, the major surface 22*a* and the top surface 21*a* may alternatively be in close contact with each other. However, it is preferable to form a space of a prescribed thickness between the dielectric substrate 21 and the radiator 22 as described later in relation to a second embodiment and the like. In this case, loss of radiated waves is suppressed by the aforementioned space, whereby the gain of the antenna can be so improved that it is possible to form a further miniaturized antenna as the result.

Further, it is possible to accomodate or form various circuit elements in the aforementioned space, thereby improving electrical properties of the antenna unit and miniaturizing an apparatus including the antenna unit.

In the antenna unit according to FIG. 4, a ground electrode 23 is formed on a side surface 21*b* of the dielectric substrate 21, or a bottom surface (a surface which is opposite to the first major surface 21*a*) of the dielectric substrate 21. On the other hand, a feed part is properly formed on a side surface of a laminate structure which is formed by the dielectric substrate 21 and the radiator 22. Namely, a feed electrode 24 may be formed on another side surface 21*c* of the dielectric substrate 21, as shown in FIG. 4. Alternatively, a feed terminal may be formed in a portion of the radiator 22 extending toward the dielectric substrate 21, as shown in various embodiments described later. Further, a ground terminal may be provided on the radiator 22 to extend toward the dielectric substrate 21.

The antenna unit according to the various embodiments of the present invention can be surface-mounted on a printed circuit board at the bottom surface of the dielectric substrate 21, whether the dielectric substrate 21 is provided on its bottom surface with the ground electrode 23 or not.

Thus, it is possible to provide a surface-mountable antenna unit according to the present invention.

DESCRIPTION OF PREFERRED EMBODIMENTS

Antenna units according to preferred embodiments of the present invention are now described. An antenna unit according to a first embodiment of the present invention has a structure with a major surface of a radiator in close contact with a top surface of a dielectric substrate, while each of the antenna units according to the second to fifth embodiments of the present invention has a structure with a space of a prescribed thickness formed between the major surface of a radiator and the top surface of a dielectric substrate. As hereinabove described, the latter structure is more preferable since it is possible to attain various effects such as improving the gain by including this space.

[First Embodiment]

Figure 5A:
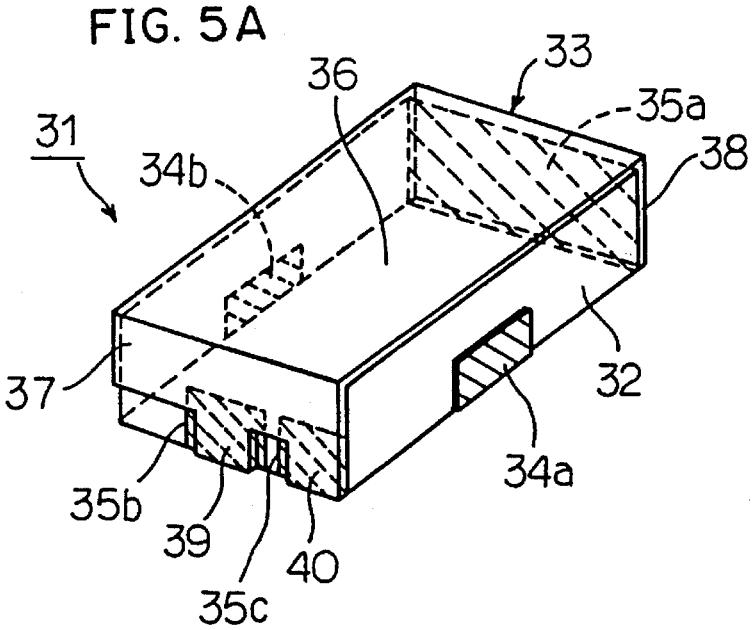
FIGS. 5A and 5B are a perspective view and an exploded perspective view showing an antenna unit according to a first embodiment of the present invention respectively.
Figure 5B:
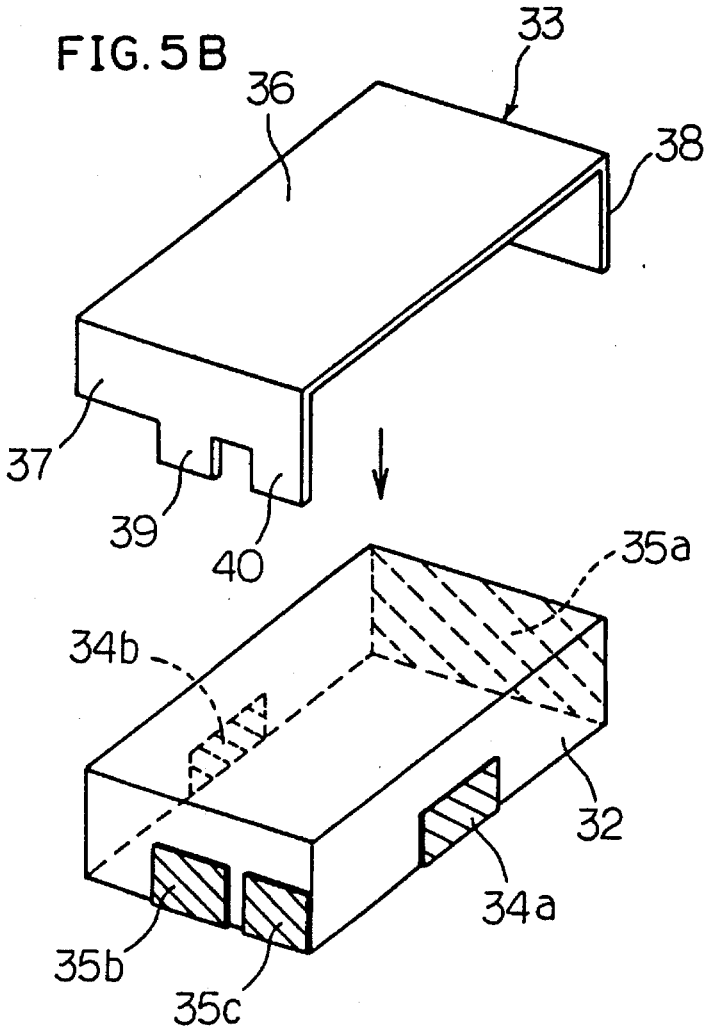

FIG. 5A is a perspective view showing the appearance of an antenna unit 31 according to the first embodiment of the present invention, and FIG. 5B is an exploded perspective view showing the antenna unit 31.

Referring to FIGS. 5A and 5B, the antenna unit 31 according to this embodiment is provided with a dielectric substrate 32 in the form of a rectangular parallelepiped, which is made of a dielectric material such as ceramics or synthetic resin, and a radiator 33 which is fixed to the dielectric substrate 32 as described later.

Ground electrodes 34*a* and 34*b* are formed on both longer side surfaces of the dielectric substrate 32. Further, connecting electrodes 35*a* to 35*c* are formed on both shorter side surfaces of the dielectric substrate 32.

On the other hand, the radiator 33 is made of a material having low conductor loss, such as copper or a copper alloy, for example. According to this embodiment, a metal plate of a metal such as copper or a copper alloy is machined to form the radiator 33.

The radiator 33 is provided with a radiating part 36 having a rectangular plane shape, and first and second fixed parts 37 and 38 which are formed by downwardly bending both shorter side edges of the radiating part 36 respectively. The fixed parts 37 and 38 are opposed to each other as shown in FIGS. 5A and 5B. A feed terminal 39 and a ground terminal 40 are integrally formed on a forward end of the fixed part 37.

In order to assemble the antenna unit 31 according to this embodiment, the dielectric substrate 32 is inserted in the radiator 33, and a major surface, i.e., an inner surface of the radiating part 36 of the radiator 33 is brought into close contact with a top surface of the dielectric substrate 32. In this state, inner surfaces of the fixed parts 37 and 38 of the radiator 33 are brought into contact with the shorter side surfaces of the dielectric substrate 32 respectively. Then, the connecting electrode 35*a* which is formed on the dielectric substrate 32 is coupled with the fixed part 38 of the radiator 33 by solder, while the connecting electrodes 35*b* and 35*c* of the dielectric substrate 32 are bonded with the feed terminal 39 and the ground terminal 40 of the radiator 33 by solder respectively. The antenna unit 31 according to this embodiment is obtained in the aforementioned manner.

In employment, the antenna unit 31 is placed on a printed circuit board (not shown) which is provided with interconnection patterns on its upper surface in the direction shown in FIG. 5A. The ground electrodes 34*a* and 34*b*, the feed terminal 39 and the ground terminal 40 are soldered to the interconnection patterns, whereby the antenna unit 31 is surface-mounted on the printed circuit board. In this case, the radiating part 36 of the radiator 33 transmits/receives electric waves in the antenna unit 31.

Since the feed terminal 39, the ground terminal 40 and the ground electrodes 34*a* and 34*b* are provided on the side surfaces, the antenna unit 31 has a flat bottom surface which is defined by that of the dielectric substrate 32. Thus, it is possible to surface-mount the antenna unit 31 on a printed circuit board, as described above.

Figure 6:
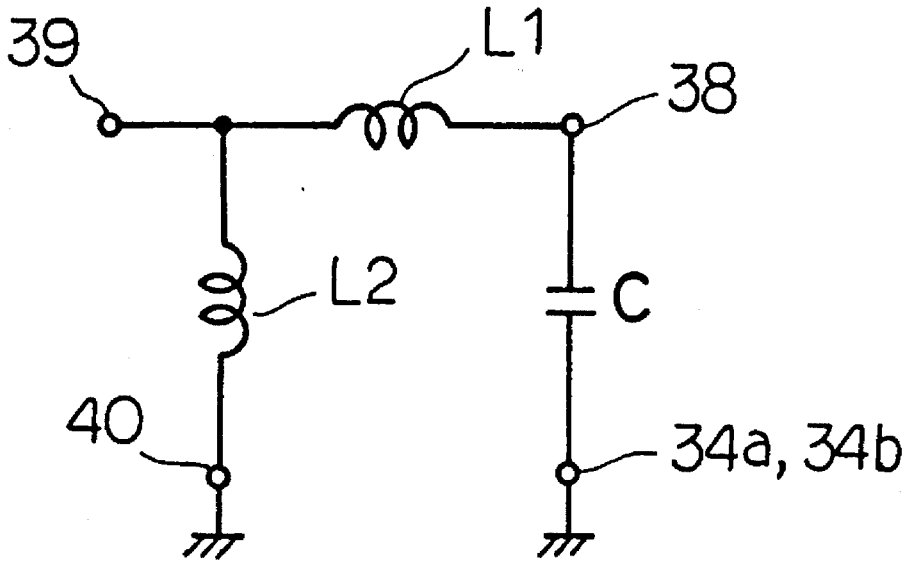
FIG. 6 shows the circuit structure of the antenna unit shown in FIG. 5A.

FIG. 6 shows an equivalent circuit of the antenna unit 31, which is formed by inductance components L1 and L2 and a capacitance component C. The inductance component L1 is mainly formed by that of the radiating part 36 of the radiator 33 and the inductance component L2 is formed by that between the feed terminal 39 and the ground terminal 40 of the radiator 33, while the capacitance component C is formed by floating capacitance between the ground electrodes 34*a* and 34*b* of the dielectric substrate 32 and the radiating part 36 of the radiator Therefore, it is possible to change the inductance value of the inductance component L2 by adjusting the distance between the feed terminal 39 and the ground terminal 40, for adjusting the impedance of the antenna unit 31 by adjusting the inductance ratio between the inductance components L1 and L2. Thus, it is possible to easily attain impedance matching between the antenna unit 31 and an external circuit.

In the antenna unit 31 according to this embodiment, the radiating part 36 for transmitting/receiving electric waves is made of a metal as hereinabove described, whereby a resistance component of the antenna unit 31 is reduced and its joule loss is reduced due to its high thermal capacity. Thus, the gain is also effectively improved in the antenna unit 31.

Figure 7:
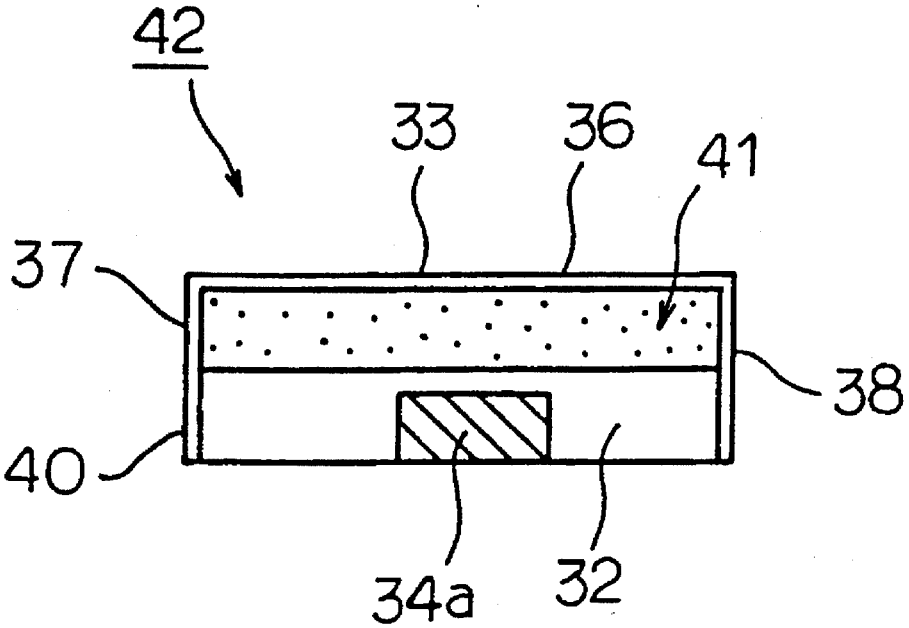
FIG. 7 is a side elevational view for illustrating an antenna unit according to a modification of the first embodiment.

As shown in FIG. 7, a dielectric layer 41 having a low dielectric constant, which is made of polyimide resin or the like, may be placed between an inner surface of a radiating part 36 of a radiator 33 and an upper surface of a dielectric substrate 32. Such an antenna unit 42 which is provided with the dielectric layer 41 attains effects and functions similar to those of the antenna unit 31 according to the first embodiment, while the Q value of this antenna unit 42 is reduced due to interposition of the dielectric layer 41, whereby it is possible to widen its frequency characteristics in relation to its gain and return loss.

The antenna unit 42 shown in FIG. 7 is a modification of the antenna unit 31 according to the first embodiment of the present invention, and it is further out that the same also corresponds to modifications of the second and third embodiments described later. While a space of a prescribed thickness is formed between an upper surface of a dielectric substrate and a lower surface of a radiating part of a radiator in each of antenna units according to the second and third embodiments of the present invention, a dielectric layer which is similar to the dielectric layer 41 of the antenna unit 42 may be arranged in this space. Thus, the antenna unit 42 also corresponds to modifications of the antenna units according to the second and third embodiments of the present invention.

[Second Embodiment]

Figure 8:
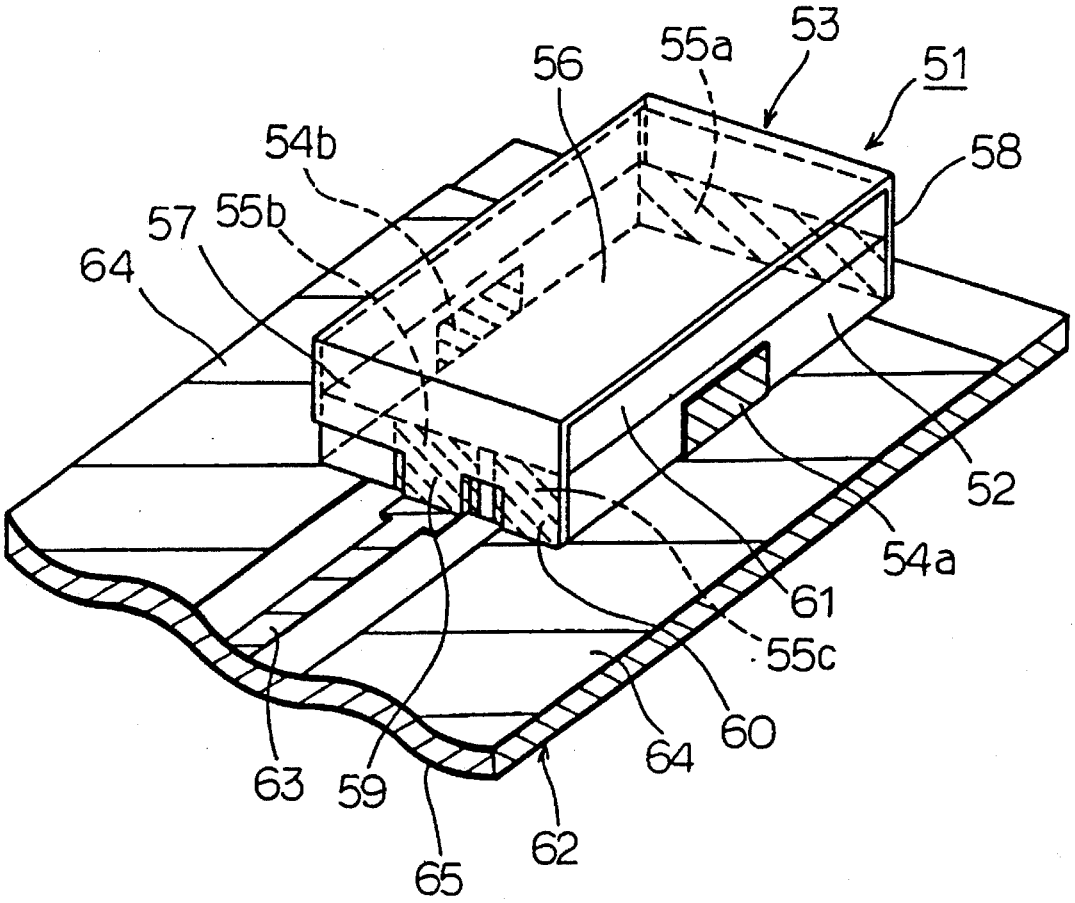
FIG. 8 is a partially fragmented perspective view showing an antenna unit according to a second embodiment of the present invention, which is surface-mounted on a printed circuit board.

FIG. 8 is a partially fragmented perspective view showing a surface-mountable antenna unit 51 according to the second embodiment of the present invention, which is mounted on a printed circuit board.

The antenna unit 51 has a dielectric substrate 52 of ceramics or synthetic resin which is in the form of a rectangular parallelepiped, and a radiator 53 which is fixed to the dielectric substrate 52 as described later. Ground electrodes 54*a* and 54*b* are formed on both longer side surfaces of the dielectric substrate 52 respectively. On the other hand, connecting electrodes 55*a*, 55*b* and 55*c* are formed on both shorter side surfaces of the dielectric substrate 52, as shown in FIG. 8. Namely, the dielectric substrate 52 is structured similarly to the dielectric substrate 32 according to the first embodiment.

The radiator 53, which is made of a metal material having low conductor loss such as copper or a copper alloy, for example, is formed by machining a metal plate. This radiator 53 comprises a radiating part 56 having a rectangular plane shape, and first and second fixed parts 57 and 58 which are formed by downwardly bending both shorter sides of the radiating part 56 respectively. A feed terminal 59 and a ground terminal 60 are integrally formed on a forward end of the fixed part 57.

The aforementioned structure is similar to that of the antenna unit 31 according to the first embodiment. The feature of the antenna unit 51 according to the second embodiment resides in that the radiator 53 is so fixed to the dielectric substrate 52 that a space 61 of a prescribed thickness is formed between a lower surface of the radiating part 56 of the radiator 53 and an upper surface of the dielectric substrate 52.

In assembling, the dielectric substrate 52 is inserted in the radiator 53. The both shorter side surfaces of the dielectric substrate 52 are brought into contact with the fixed parts 57 and 58 respectively. The connecting electrode 55*a* which is provided on the dielectric substrate 52 is bonded to the fixed part 58 by solder. Similarly, the connecting electrodes 55*b* and 55*c* are bonded to the feed terminal 59 and the ground terminal 60 by solder respectively.

In the structure shown in FIG. 8, the antenna unit 51 is surface-mounted on a printed circuit board 62. A feed line 63 and earth electrodes 64 are formed on an upper surface of the printed circuit board 62, while an earth electrode 65 is formed on its lower surface. The feed terminal 59 of the antenna unit 51 is soldered to the feed line 63, while the ground electrodes 54*a* and 54*b* and the ground terminal 60 are soldered to the earth electrodes 64.

In the antenna unit 51 which is surface-mounted on the printed circuit board 62 in the aforementioned manner, the radiating part 56 of the radiator 53 transmits/receives electric waves.

The antenna unit 51 according to this embodiment is structured similarly to the antenna unit 31 according to the first embodiment, except that the aforementioned space 61 is provided. Thus, the antenna unit 51 has functions/effects which are similar to those of the antenna unit 31 according to the first embodiment.

In addition, the spacing between the radiating part 56 and the dielectric substrate 52 and the ground electrodes 54*a* and 54*b* is increased by the space 61. Consequently, overcurrents which are generated by a magnetic field in the earth electrodes 64 provided on the printed circuit board 62 are suppressed and there is very little electric field concentration in the interior of the dielectric substrate 52. These functions of the space 61 are described below in detail in a fourth embodiment with reference to FIG. 30. Particularly, a high-frequency current flows in the radiating part of the radiator. Namely, the high-frequency current flows from the feed terminal toward the side surface which is opposed to that provided with the feed terminal, so that a magnetic field is developed around this high-frequency current. Thus, an electric field is developed around the magnetic field, so that the radiating part radiates electric waves. At this time, an overcurrent which is developed on the ground surface by the aforementioned magnetic field is suppressed due to the space provided between the radiating part of the radiator and the surface of the dielectric substrate. In addition, the electric field hardly concentrates in the interior of the dielectric substrate. Thus, the radiation efficiency of the electric waves is further improved and hence the gain of the antenna unit 51 is further improved. Therefore, it is possible to ensure a sufficient gain also when the antenna unit 51 is further miniaturized.

An equivalent circuit of the antenna unit 51 according to this embodiment is similar to that of the antenna unit 31 according to the first embodiment.

Figure 9:
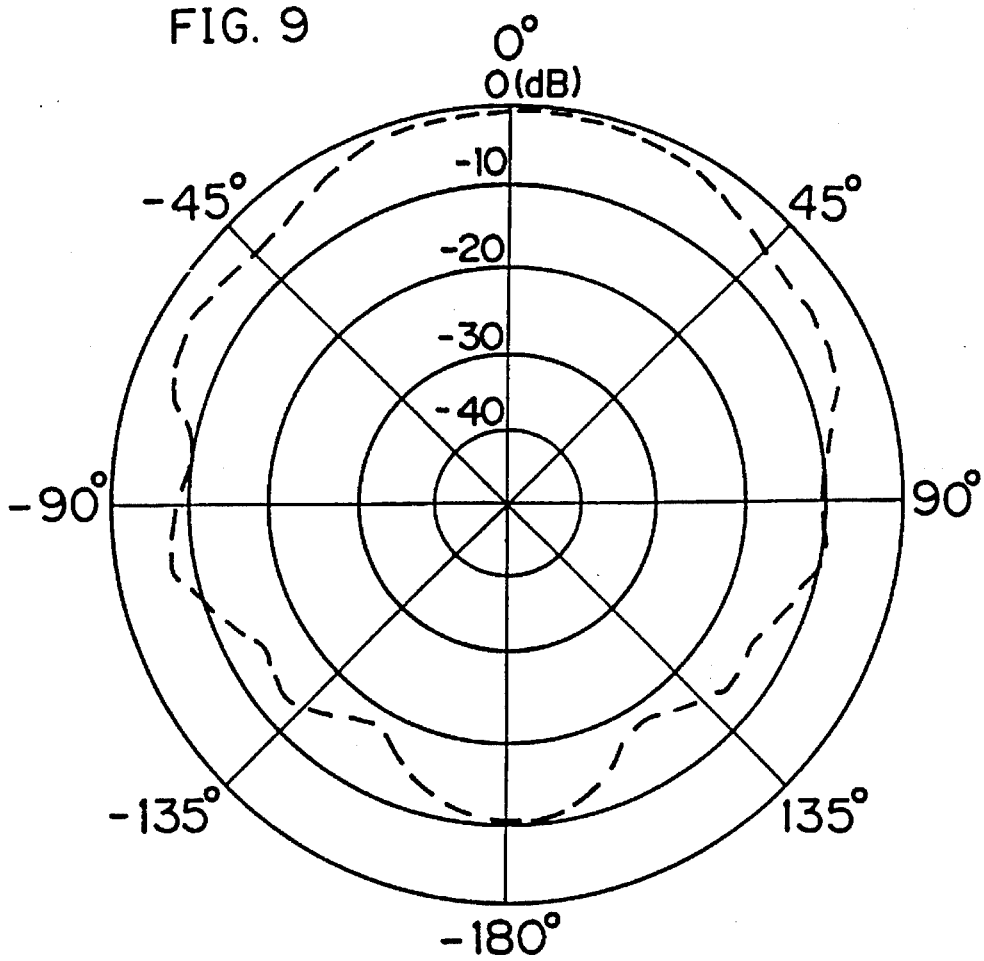
FIG. 9 illustrates a directional pattern of the antenna unit shown in FIG. 8.

FIG. 9 illustrates an exemplary directional pattern of the antenna unit 51 according to this embodiment. The directional pattern shown in FIG. 9 is that attained in an antenna unit of 10 mm in length, 6.3 mm in width and 4 mm in height, with a resonance frequency of 1.9 GHz. As clearly understood from FIG. 9, this antenna unit has an excellent maximum gain of −1 dB, and its size can be remarkably reduced as compared with a conventional microstrip antenna since the longest portion thereof is about 1/16 the wavelength of electric waves as transmitted/received.

Figure 10:
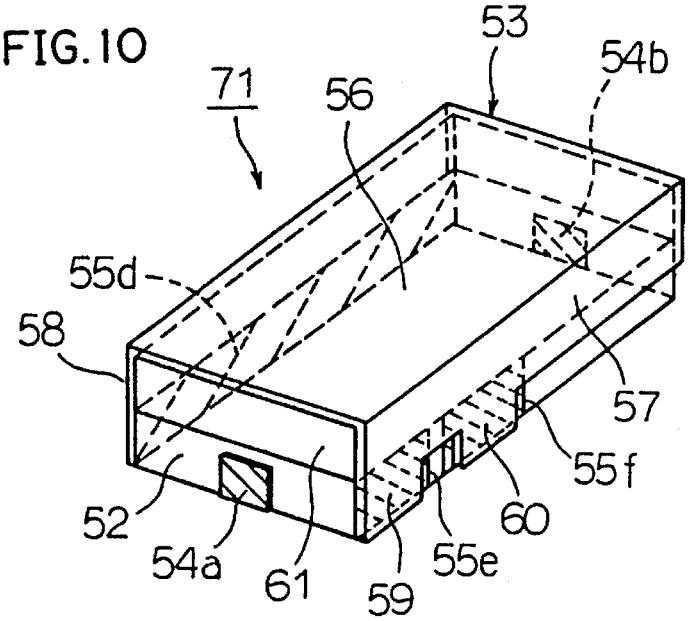
FIG. 10 is a perspective view showing a first modification of the antenna unit according to the second embodiment of the present invention.

FIG. 10 is a perspective view showing a first modification of the antenna unit according to the second embodiment.

In an antenna unit 71 of this modification shown in FIG. 10, positions of fixed parts provided on a radiator differ from those of the antenna unit 51 according to the second embodiment, while positions of electrodes provided on a dielectric substrate 52 also differ from those of the second embodiment. Other points of this modification are identical to those of the antenna unit 51 according to the second embodiment. Therefore, portions identical to those of the second embodiment are denoted by the same reference numerals, to omit redundant description.

Ground electrodes 54*a* and 54*b* are formed on both shorter side surfaces of the dielectric substrate 52 respectively, while connecting electrodes 55*d* to 55*f* are formed on both longer side surfaces thereof. On the other hand, both longer sides of a radiating part 56 are downwardly bent to form first and second opposite fixed parts 57 and 58 in a radiator 53. A feed terminal 59 and a ground terminal 60 are formed on a forward end of the fixed part 57. The feed terminal 59 is electrically connected to the connecting electrode 55*e*. On the other hand, the ground terminal 60 is electrically connected to the connecting electrode 55*f*. The ground electrodes 54*a* and 54*b* which are exposed on the side surfaces are electrically connected to earth electrodes (not shown) provided on a printed circuit board.

Figure 11:
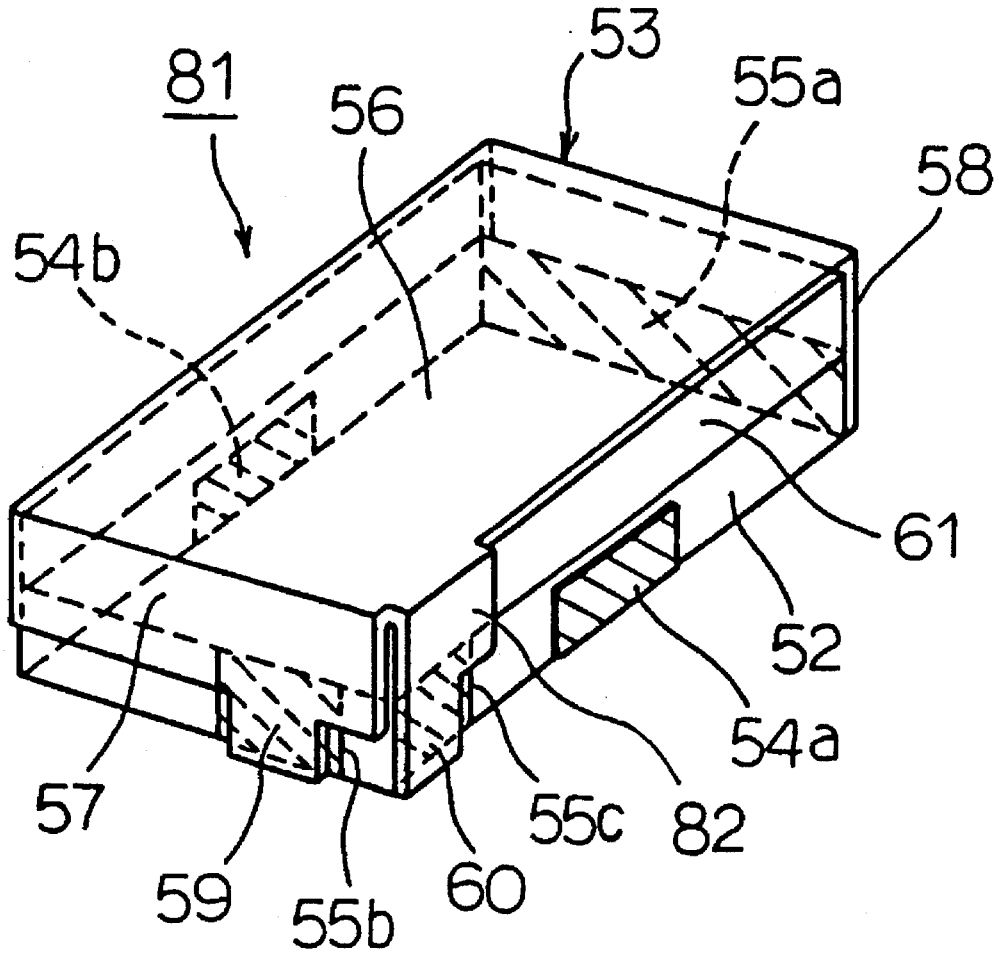
FIG. 11 is a perspective view showing a second modification of the antenna unit according to the second embodiment of the present invention.

FIG. 11 is a perspective view showing an antenna unit 81 according to a second modification of the antenna unit according to the second embodiment of the present invention.

In the antenna unit 81 according to the second modification, shorter side edges of a metal plate are downwardly bent in a radiating part 56 of a radiator 53 to form first and second opposite fixed parts 57 and 58, while a longer side edge of the metal plate is also downwardly bent to form a third fixed part 82. A feed terminal 59 is integrally formed on a forward end of the fixed part 57, while a ground terminal 60 is integrally formed on a forward end of the fixed part 82. Namely, the feed terminal 59 and the ground terminal 60 are dispersed on two different sides of the radiating part 56 in this antenna unit 81. Also in this case, it is possible to adjust an inductance value across the feed terminal 59 and the ground terminal 60 by adjusting the distance therebetween, thereby easily attaining impedance matching between the antenna unit 81 and an external circuit.

The antenna unit 81 is provided with the feed terminal 59 and the ground terminal 60 in the aforementioned manner, and hence connecting electrodes 55b and 55c which are electrically connected with these terminals are also formed on different side surfaces of the dielectric substrate 52, as shown in FIG. 11.

Other points of this modification are similar to those of the antenna unit 51 according to the second embodiment, and hence portions identical to those in FIG. 8 are denoted by the same reference numerals, to omit redundant description.

As understood from the aforementioned antenna units 51, 71 and 81, three or more fixed parts may be provided on the radiator 53. However, it is preferable to provide a pair of opposite fixed parts, in order to reliably fix the radiator 53 to the dielectric substrate 52.

Also in each of the aforementioned first embodiment and third and fourth embodiments described later, it is possible to form three or more fixed parts similarly to the above.

As understood from the antenna units 51, 71 and 81, the feed terminal 59 and the ground terminal 60 may be formed on either the longer or shorter side of the radiating part 56, provided in parallel in fixed parts which are adjacently provided on the same side of the radiating part 56, or dispersed in different fixed parts which are provided in series on different sides of the radiating part 56. Such modifications are also applicable to the aforementioned first embodiment and third and fourth embodiments described later.

In the antenna unit 51 according to the second embodiment, the aforementioned space 61 is formed between the dielectric substrate 52 and the radiating part 56 of the radiator 53, whereby it is possible to suppress loss of radiated energy as hereinabove described, thereby effectively improving the gain of the antenna. Preferably, the aforementioned space 61 is maintained at a constant height, thereby obtaining an antenna unit having stable characteristics. With reference to FIGS. 12A to 15, a description is now made of various space holding means, each of which is adapted to maintain the space 61 at a constant height.

Projections which are provided on dielectric substrates for serving as space holding means are now described with reference to FIGS. 12A to 12D, in which the dielectric substrates and electrodes which are formed thereon are similar to the dielectric substrate 52 shown in FIG. 8, and hence redundant description is omitted.

Figure 12A:
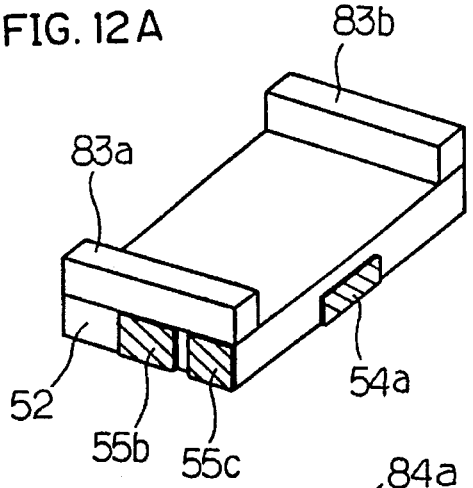
FIGS. 12A, 12B, 12C, 12D are perspective views showing a pair of strip-shaped projections which are formed along a pair of shorter side edges of a dielectric substrate, a pair of strip-shaped projections which are formed along a pair of longer side edges on an upper surface of a dielectric substrate, an annular projection which is formed on an upper surface of a dielectric substrate, and a plurality of projections which are formed on an upper surface of a dielectric substrate for serving as space holding means respectively.
Figure 12B:
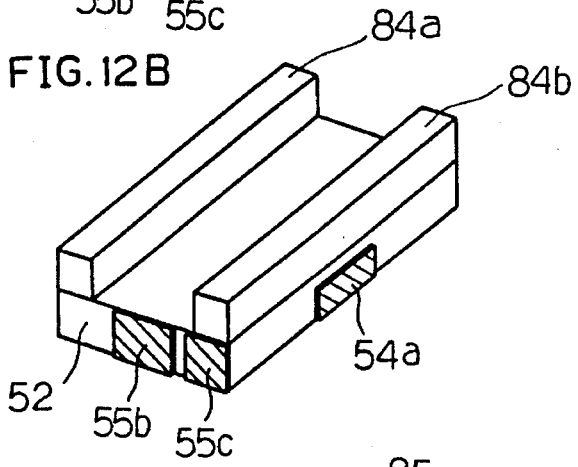
Figure 12C:
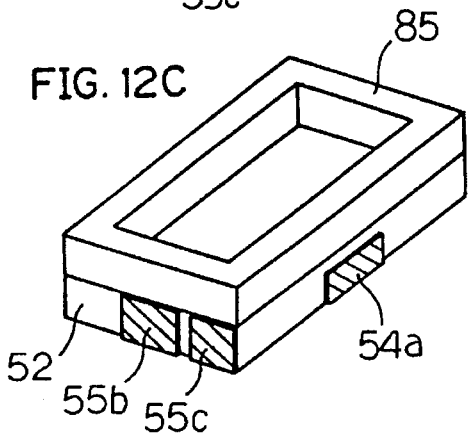
Figure 12D:
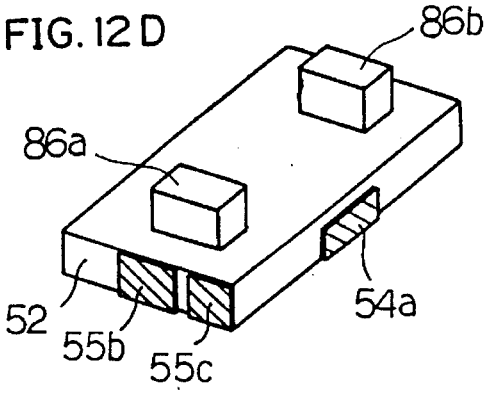

Referring to FIG. 12A, first and second strip-shaped projections 83a and 83b are formed on an upper surface of a dielectric substrate 52. These projections 83a and 83b are arranged along both shorter sides on the upper surface of the dielectric substrate 52. Referring to FIG. 12B, first and second strip-shaped projections 84a and 84b are arranged along longer sides on an upper surface of a dielectric substrate 52. Referring to FIG. 12C, a closed ring-shaped projection 85 is formed on an upper surface of a dielectric substrate 52. The closed ring-shaped projection 85 is sized to be along four sides of the dielectric substrate 52. Referring to FIG. 12D, a plurality of projections 86a and 86b are formed on an upper surface of a dielectric substrate 52 within the space, but not to reach edges of the dielectric substrate 52.

Figure 13:
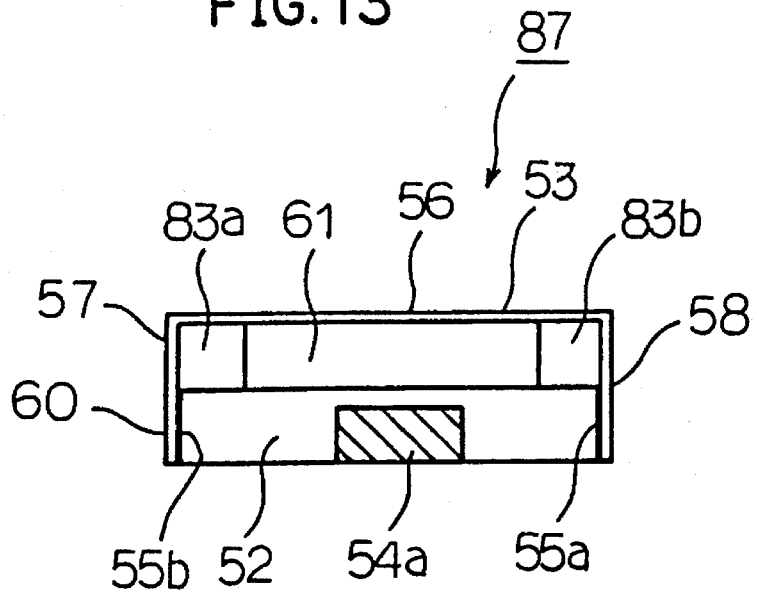
FIG. 13 is a side elevational view showing a third modification of the antenna unit according to the second embodiment of the present invention.

Each of the aforementioned projections 83a to 86b is brought into contact with the inner surface of the radiating part 56 of the aforementioned radiator 53, thereby reliably maintaining the aforementioned space 61 at a constant height. Referring to FIG. 13, this state is now described with reference to the strip-shaped projections 83a and 83b shown in FIG. 12A. In an antenna unit 87 shown in FIG. 13, upper surfaces of the strip-shaped projections 83a and 83b are brought into contact with an inner surface of a radiating part 56 of a radiator 53, thereby reliably maintaining a space 61 at a constant height and stabilizing the gain of the antenna unit 87.

The projections 83a to 86b having the aforementioned functions can be made of proper materials such as ceramics and synthetic resin. Alternatively, the projections 83a to 86b can be made of the same materials as the dielectric substrates 52, to be integrally molded with the dielectric substrates 52.

Fourth and fifth modifications of the second embodiment of the present invention, which are provided with space holding means on radiators 53, are now described with reference to FIGS. 14 and 15.

Figure 14:
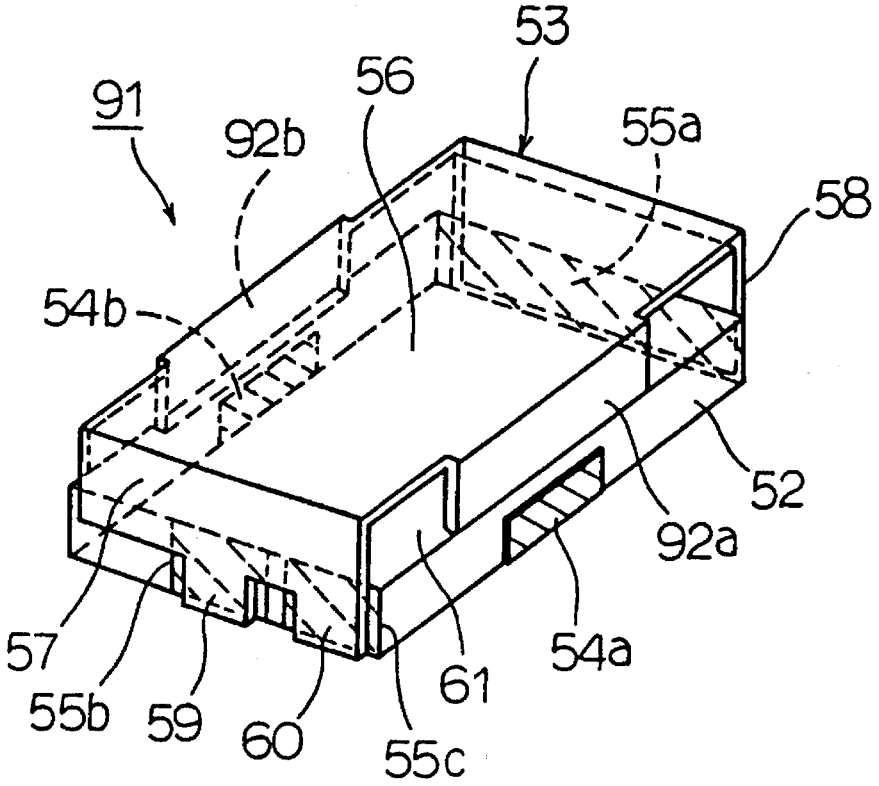
FIG. 14 is a perspective view showing a fourth modification of the antenna unit according to the second embodiment of the present invention, in which stop members serving as space holding means are provided on a pair of longer side edges of a radiator.

In an antenna unit 91 shown in FIG. 14, the radiator 53 is fixed to a dielectric substrate 52 in a structure which is similar to that in the antenna unit 51 according to the second embodiment.

The feature of this antenna unit 91 resides in that both longer side edges of a radiating part 56 of the radiator 53 are downwardly bent to form stop members 92a and 92b. These stop members 92a and 92b are adapted to maintain a space 61 at a constant height. Namely, forward ends of the stop members 92a and 92b are brought into contact with an upper surface of the dielectric substrate 52, thereby maintaining the space 61 at a constant height.

The stop members 92a and 92b have certain degrees of widths, i.e., dimensions along a direction perpendicular to that of the height of the space 61, thereby improving mechanical strength of the radiator 53.

Figure 15:
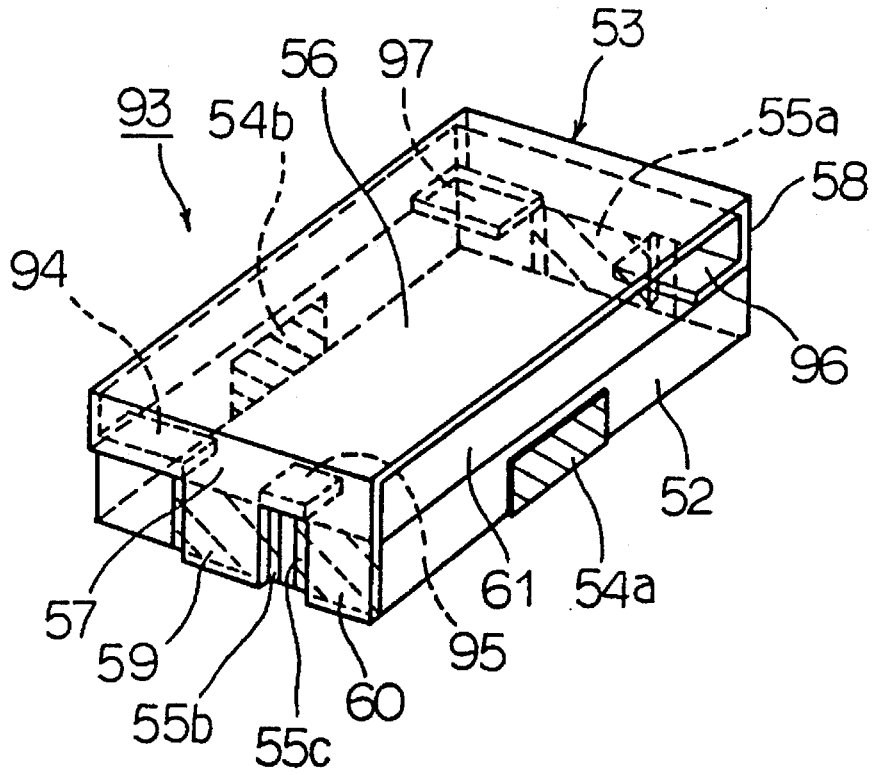
FIG. 15 is a perspective view showing a fifth modification of the antenna unit according to the second embodiment of the present invention, in which stop members serving as space holding means have stop surface parts to be in contact with both surfaces of a dielectric substrate.

FIG. 15 shows an antenna unit 93 according to the fifth modification of the second embodiment, which is provided with similar stop members. In the antenna unit 93 shown in FIG. 15, fixed parts 57 and 58 extend from both shorter side edges of a radiating part 56 of a radiator 53, which is fixed to a dielectric substrate 52, toward the dielectric substrate 52. Stop members 94 to 97 are inwardly bent in lower ends of the fixed parts 57 and 58 respectively, to extend in parallel with an upper surface of the dielectric substrate 52. Lower surfaces of the stop members 94 to 97 are brought into contact with the upper surface of the dielectric substrate 52, thereby maintaining a space 61 at a constant height. Thus, it is possible to stabilize the gain of the antenna similarly to the aforementioned space holding means.

As clearly understood from each of FIGS. 14 and 15, the space holding means for maintaining the space 61 at a constant height may be formed by stop members provided on the radiator 53, and these stop members may be arranged on either the longer or shorter side edge of the radiating part 56.

As clearly understood from the stop members 92a and 92b and 94 to 97, further, the stop members can be formed by directly bending the metal plate from edges of the radiating part, or by bending the metal plate at forward ends of the fixed parts.

The antenna unit 51 according to the second embodiment shown in FIG. 8 preferably further comprises a capacitor which is connected to the radiator 53. FIGS. 16 to 19 show modifications of dielectric plates provided with such capacitors respectively.

Figure 16:
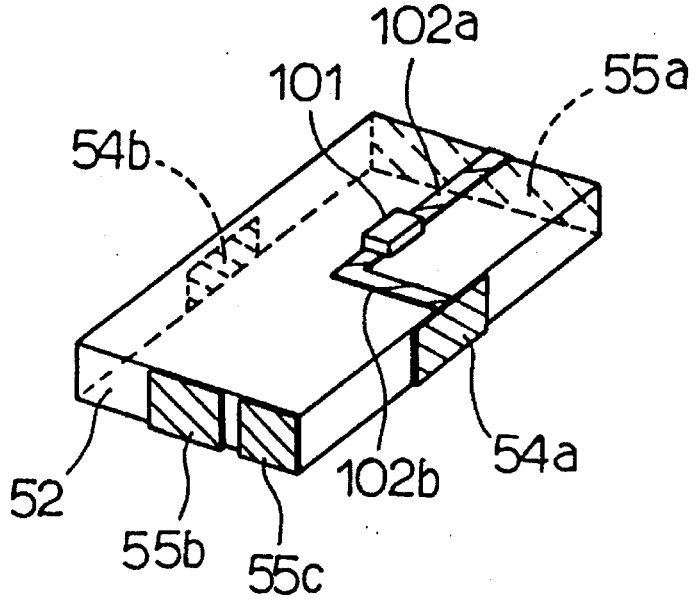
FIG. 16 is a perspective view showing the antenna unit according to the second embodiment of the present invention, in which a capacitor is carried on the dielectric substrate.

Referring to FIG. 16, a chip-type multilayer capacitor 101 is mounted on an upper surface of a dielectric substrate 52. An electrode of the multilayer capacitor 101 is electrically connected to a connecting electrode 55a through an electrode pattern 102a which is formed on the upper surface of the dielectric substrate 52. Another electrode of the capacitor 101 is electrically connected to a ground electrode 54a through another electrode pattern 102b.

Figure 17:
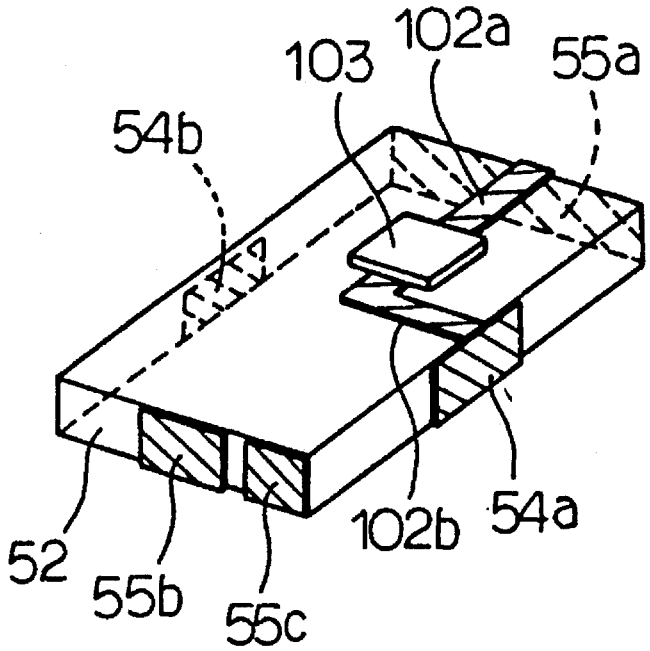
FIG. 17 is a perspective view for illustrating such an example that a capacitor is formed on the dielectric substrate through a dielectric layer by printing.

Referring to FIG. 17, a dielectric substrate 52 is provided on its upper surface with electrode patterns 102*a* and 102*b* which are electrically connected with a connecting electrode 55*a* and a ground electrode 54*a* respectively. A dielectric material layer 103 is printed between the electrode patterns 102*a* and 102*b*, to form a capacitor. This capacitor is so formed that electrostatic capacitance by the dielectric material layer 103 is drawn out through the electrode patterns 102*a* and 102*b* serving as capacitor electrodes. The dielectric material layer 103 can be formed by printing paste which is kneaded with synthetic resin or dielectric ceramics.

Figure 18:
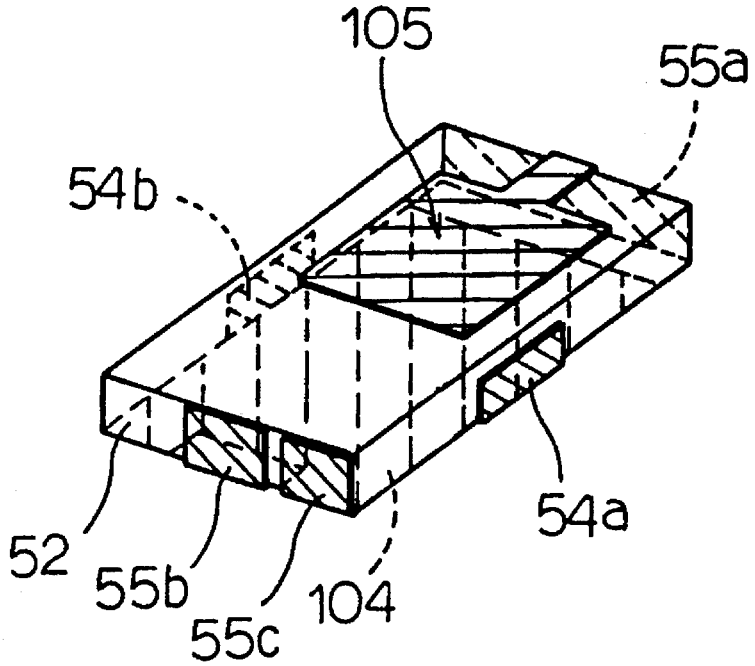
FIG. 18 is a perspective view showing a dielectric substrate for illustrating such an example that a capacitor is formed through the dielectric substrate.

Referring to FIG. 18, a dielectric substrate 52 is provided on its lower surface with a ground electrode pattern 104 which is electrically connected with ground electrodes 54*a* and 54*b*. On the other hand, a capacitor electrode 105 is formed on an upper surface of the dielectric substrate 52. This capacitor electrode 105 is electrically connected with a connecting electrode 55a. Thus, a capacitor is formed between the capacitor electrode 105 and the ground electrode pattern 104.

Figure 19:
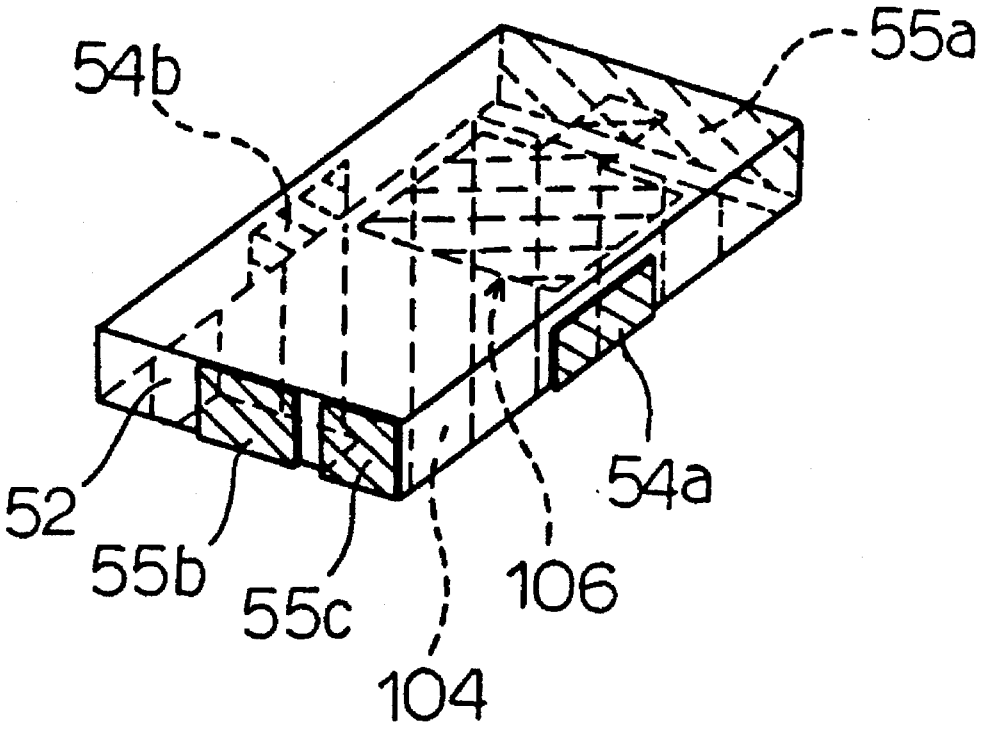
FIG. 19 is a perspective view showing a dielectric substrate which is provided therein with an electrode for forming a capacitor.

Referring to FIG. 19, a capacitor electrode 106 is formed in the interior of a dielectric substrate 52. This capacitor electrode 106 is electrically connected with a connecting electrode 55*a*. Further, a ground electrode pattern 104 is formed on a lower surface of the dielectric substrate 52. Thus, a capacitor is formed between the capacitor electrode 106 and the ground electrode pattern 104.

Each of the ground electrode patterns 104 shown in FIGS. 18 and 19 formed on the lower surface of the dielectric substrates 52 is so provided that the same is not electrically connected with the connecting electrode 55*b*, which is to be connected to a feed terminal, and the connecting electrode 55*a*.

In each of the aforementioned modifications shown in FIGS. 16 to 19, the capacitor is formed on or in the dielectric substrate 52 so that the electrodes thereof are electrically connected to the connecting electrode 55*a* and the ground electrode 54*a* respectively. Thus, the connecting electrode 55*a* is electrically connected to the radiator 53 in the antenna unit 51 according to the second embodiment, whereby the capacitor is electrically connected between the radiator 53 and the ground potential. Consequently, this capacitor functions to improve the capacitance value of the capacitor C in the equivalent circuit shown in FIG. 6, to enable reduction of the resonance frequency of the antenna unit 51 or facilitate miniaturization of the antenna unit.

The dielectric substrates 52 having capacitors shown in FIGS. 16 to 19 can be properly applied to the antenna units 51, 71, 81, 91 and 93 according to the second embodiment and the modifications thereof, as well as to the dielectric substrates 52 provided with the projections 83*a* to 86*b* shown in FIGS. 12A to 12D.

The capacitor shown in FIG. 19, which is formed in the dielectric substrate 52, can also be applied to the antenna unit 31 according to the first embodiment shown in FIG. 5A. Also in the antenna unit 31 according to the first embodiment, therefore, it is possible to reduce the resonance frequency of the antenna and miniaturize the same by electrically connecting a capacitor between the radiator 3 and the ground electrodes 34*a* and 34*b*.

On the other hand, it is also possible to provide proper ones of the projections 83*a* to 86*b* shown in FIGS. 12A to 12D in the dielectric substrates 52 provided with capacitors shown in FIGS. 16 to 19.

[Third Embodiment]

With reference to FIGS. 20 to 24, description is now made of an antenna unit according to a third embodiment, which is conceivably the best mode for carrying out the present invention.

Figure 20:
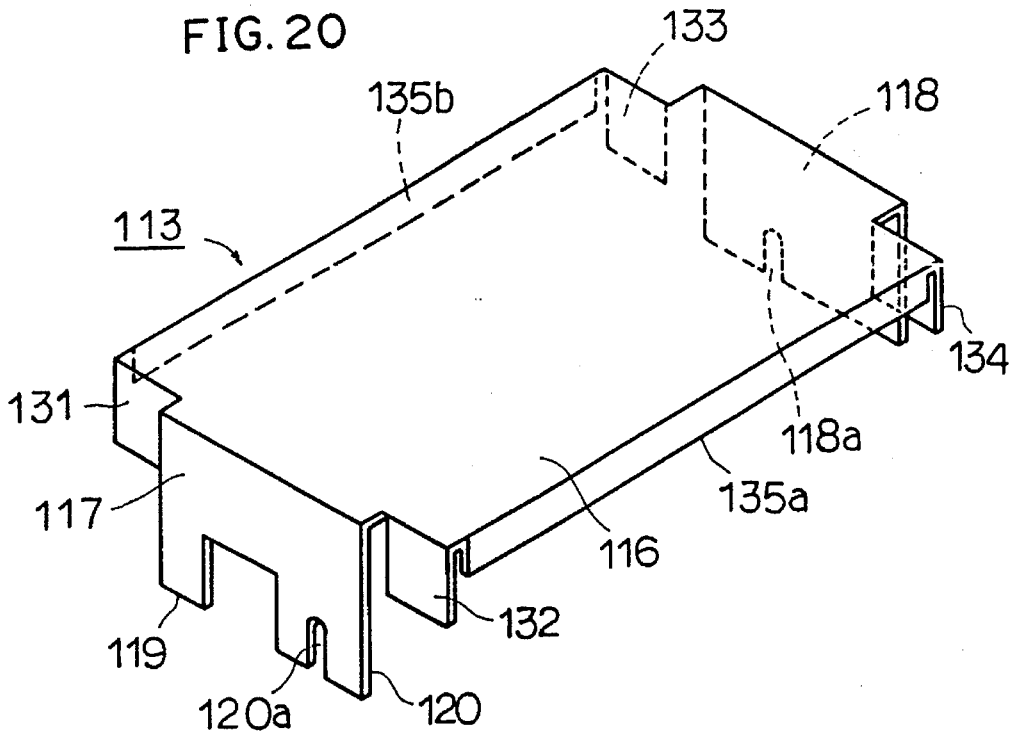
FIG. 20 is a perspective view showing a radiator which is employed for an antenna unit according to a third embodiment of the present invention.

FIG. 20 is a perspective view showing a radiator 113 which is employed in the third embodiment of the present invention. This radiator 113 is formed by machining a material having low conductor loss, such as a metal material of copper or a copper alloy, for example. The radiator 113 comprises a radiating part 116 having a rectangular plane shape. Both shorter sides of the radiating part 116 are downwardly bent to form first and second fixed parts 117 and 118 respectively. A feed terminal 119 and a ground terminal 120 are integrally formed on a forward end of the first fixed part 117.

The structure which is provided with the first and second fixed parts 117 and 118, the feed terminal 119 and the ground terminal 120 itself is similar to those of the radiators 3 and 53 of the antenna units 31 and 51 according to the first and second embodiments. According to the third embodiment, the fixed parts 117 and 118 are provided on forward ends thereof with frontwardly opening slits 120*a* and 118*a* for serving as solder injection parts. In the fixed part 117, the slit 120*a* is formed in a portion provided with the ground terminal 120.

Further, stop members 131 to 134 are formed on both sides of the first and second fixed parts 117 and 118 for serving as space holding means. The stop members 131 to 134 are brought into contact with an upper surface of a dielectric substrate 112 as described later, to reliably form a space of a prescribed height between the inner major surface of the radiating part 116 and the upper surface of the dielectric substrate 112.

In the radiator 113, further, both sides of the radiating part 116 are downwardly bent to form reinforcing side surface parts 135*a* and 135*b*. These reinforcing side surface parts 135*a* and 135*b* are adapted to improve the mechanical strength of the radiator 113. While the reinforcing side surface parts 135*a* and 135*b* are smaller in vertical length than the stop members 131 to 134 as shown in FIG. 20 according to this embodiment, lower ends of the reinforcing side surface parts 135*a* and 135*b* may alternatively be flush with those of the stop members 131 to 134, so that the reinforcing side surface parts 135*a* and 135*b* may also serve as stop members.

The stop members 131 to 134 are bent portions of the radiating part 116 at positions which are inward beyond the fixed parts 117 and 118, so that the stop members 131 to 134 can be reliably brought into contact with the upper surface of the dielectric substrate 112 upon assembling of the antenna unit as described later.

Figure 21:
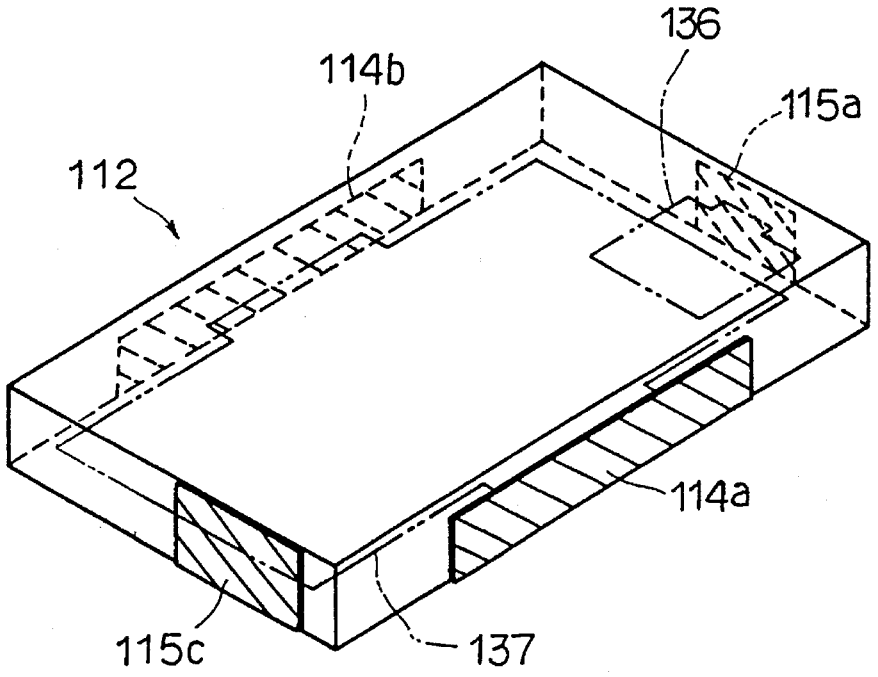
FIG. 21 is a perspective view showing a dielectric substrate which is employed for the antenna unit according to the third embodiment of the present invention.
Figure 22:
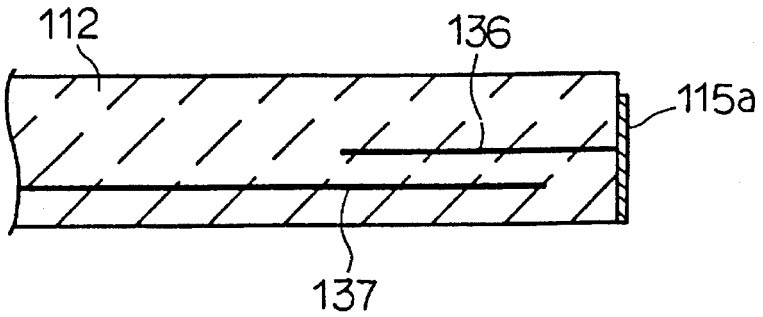
FIG. 22 is a partially fragmented side sectional view showing an internal structure of the dielectric substrate which is employed for the antenna unit according to the third embodiment of the present invention.

Referring to FIG. 21, the dielectric substrate 112, which is made of ceramics or synthetic resin, is in the form of a rectangular parallelepiped. Ground electrodes 114*a* and 114*b* are formed on both longer side surfaces of the dielectric substrate 112 respectively. Further, connecting electrodes 115*a* and 115*c* are formed on both shorter side surfaces of the dielectric substrate 112. In addition, a capacitor electrode 136 is formed at an intermediate vertical position within the dielectric substrate 112. This capacitor electrode 135 is electrically connected to the connecting electrode 115*a*. In the interior of the dielectric substrate 112, a ground electrode pattern 137 is formed under the capacitor electrode 136. This ground electrode pattern 137 is electrically connected with the ground electrodes 114*a* and 114*b*. Therefore, a capacitor is formed by the capacitor electrode 136, the ground electrode pattern 137 and a dielectric substrate layer located therebetween, as shown in FIG. 22 in a partially fragmented side sectional view. Namely, the dielectric substrate 112 employed in this embodiment has a function which is similar to those of the dielectric substrates 52 provided with capacitors shown in FIGS. 16 to 19.

Figure 23:
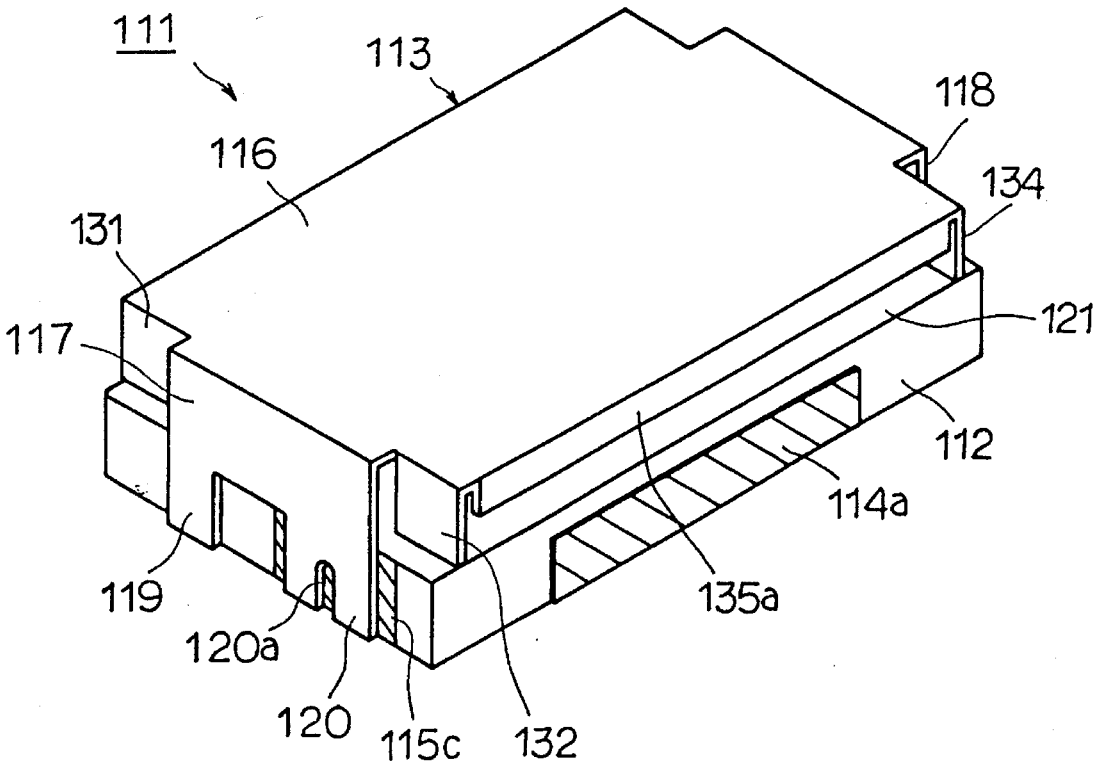
FIG. 23 is a perspective view showing the appearance of the antenna unit according to the third embodiment of the present invention.

FIG. 23 is a perspective view showing an antenna unit 111 according to the third embodiment, which is formed by fixing the aforementioned radiator 113 to the dielectric substrate 112. In order to assemble the antenna unit 111, the dielectric substrate 112 is inserted between the first and second fixed parts 117 and 118 of time radiator 113. In this case, the dielectric substrate 112 is inserted in the radiator 113 until the stop members 131 to 134 are in contact with the upper surface of the dielectric substrate 112. The first fixed part 117 is soldered to the connecting electrode 115*c* and the second fixed part 118 is soldered to the connecting electrode 115*a*, thereby obtaining the antenna unit 111. The connecting electrode 115*a* is electrically connected with the second fixed part 118 by such soldering, whereby a capacitor which is formed by the capacitor electrode 136 and the ground electrode pattern 137 is connected between the radiator 113 and the ground electrodes 114*a* and 114*b*.

According to this embodiment, it is possible to further reliably bond the first and second fixed parts 117 and 118 to the connecting electrodes 115*a* and 115*c* which are provided on the dielectric substrate 112 by injecting solder paste into the slits 118*a* and 120*a*. Namely, solder discharge parts of dispensers for injecting solder paste are introduced into the slits 118*a* and 120*a* to inject solder paste so that the solder paste adheres to the connecting electrodes 115*a* and 115*c* which are provided on the outer surfaces of the dielectric substrate 112, and the solder paste is heated to smoothly spread in clearances between the connecting electrodes 115*a* and 115*c* and the first and second fixed parts 117 and 118. Thus, it is possible to reliably increase bonding areas between the first and second fixed parts 117 and 118 and the connecting electrodes 115*a* and 115*c*, thereby reliably improving bonding strength.

Figure 24:
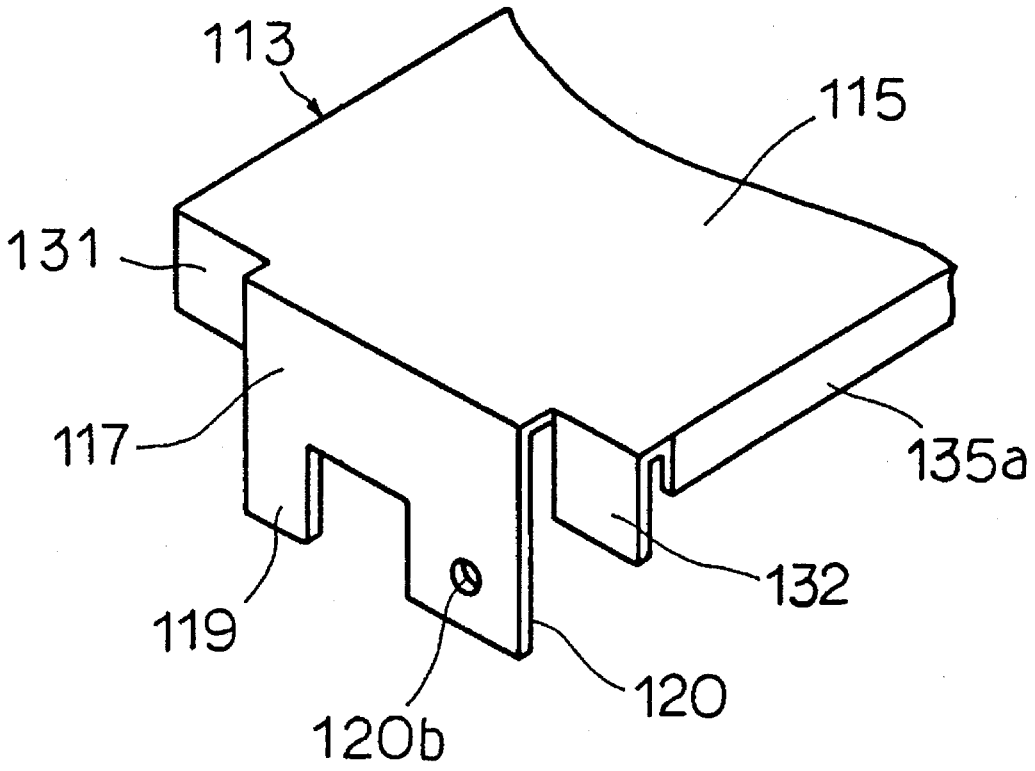
FIG. 24 is a partially fragmented perspective view showing a part of a radiator, for illustrating a modification of solder injection parts.

While the slits 118*a* and 120*a* serve as solder injection parts according to this embodiment, each of such slits may be replaced by a through hole 120*b* which is provided on the first or second fixed part 117 or 118, as shown in FIG. 24 in a partially fragmented perspective view. In other words, the solder injection parts can be provided in appropriate shapes so far as the solder paste can be applied through them to the electrodes 115*a* and 115*c* which are provided on the outer surfaces of the dielectric substrate 112.

The antenna unit 111 according to the third embodiment of the present invention has an equivalent circuit which is similar to that shown in FIG. 6 in relation to the antenna unit 31 according to the first embodiment.

Namely, the antenna unit 111 according to this embodiment can be surface-mounted similarly to the antenna units according to the aforementioned embodiments and modifications, since the antenna unit 111 functions in a similar manner to the antenna unit 31 according to the first embodiment and the dielectric substrate 112 has a flat lower surface. Further, the feed terminal 119 and the ground terminal 120 are formed on the forward end of the first fixed part 117, whereby it is possible to adjust an inductance component developed across the feed terminal 119 and the ground terminal 120 by adjusting the distance therebetween. Thus, it is possible to easily attain impedance matching between the antenna unit 111 and an external circuit, similarly to the antenna units 31 and 51 according to the first and second embodiments.

Further, loss of radiated energy is suppressed by a space 121 between the radiating part 116 and the dielectric substrate 112 similarly to the antenna unit 51 according to the second embodiment, whereby the gain of the antenna is effectively improved. Further, the space 121 is reliably maintained at a constant height due to the stop members 131 to 134.

In addition, it is also possible to improve the mechanical strength of the radiator 113 which is arranged above the dielectric substrate 112, due to the reinforcing side surface parts 135*a* and 135*b*.

Since a capacitor is formed by the capacitor electrode 136 and the ground electrode pattern 137 in the dielectric substrate 112, it is possible to reduce the resonance frequency and facilitate miniaturization of the antenna unit 111. Further, this capacitor, which is contained in the dielectric substrate 112, can be defined by simply preparing the dielectric substrate 112, to provide the aforementioned function. In other words, it is possible to omit a complicated capacitor mounting operation and an operation for printing a material or an electrode for forming the capacitor on the dielectric substrate 112.

[Fourth Embodiment]

An antenna unit 151 according to a fourth embodiment of the present invention is now described with reference to FIGS. 25 to 32. In the antenna unit 151 according to the fourth embodiment, a space is provided between a dielectric substrate and a radiator, similarly to the antenna unit 51 according to the second embodiment. Further, the feature of the fourth embodiment resides in that the antenna unit 151 encloses another circuit element such as an antenna switching circuit 171, as described later.

Figure 25:
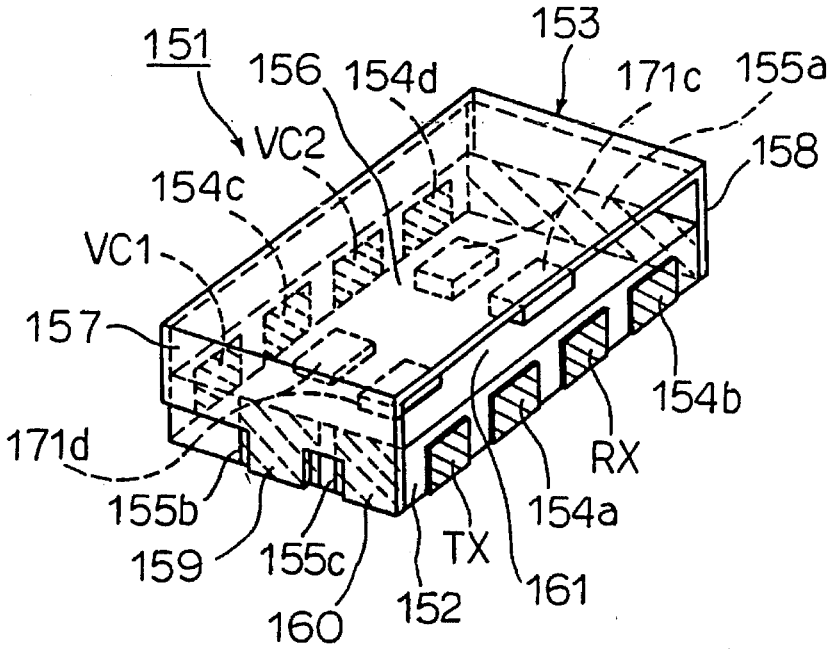
FIG. 25 is a perspective view showing an antenna unit according to a fourth embodiment of the present invention.
Figure 26:
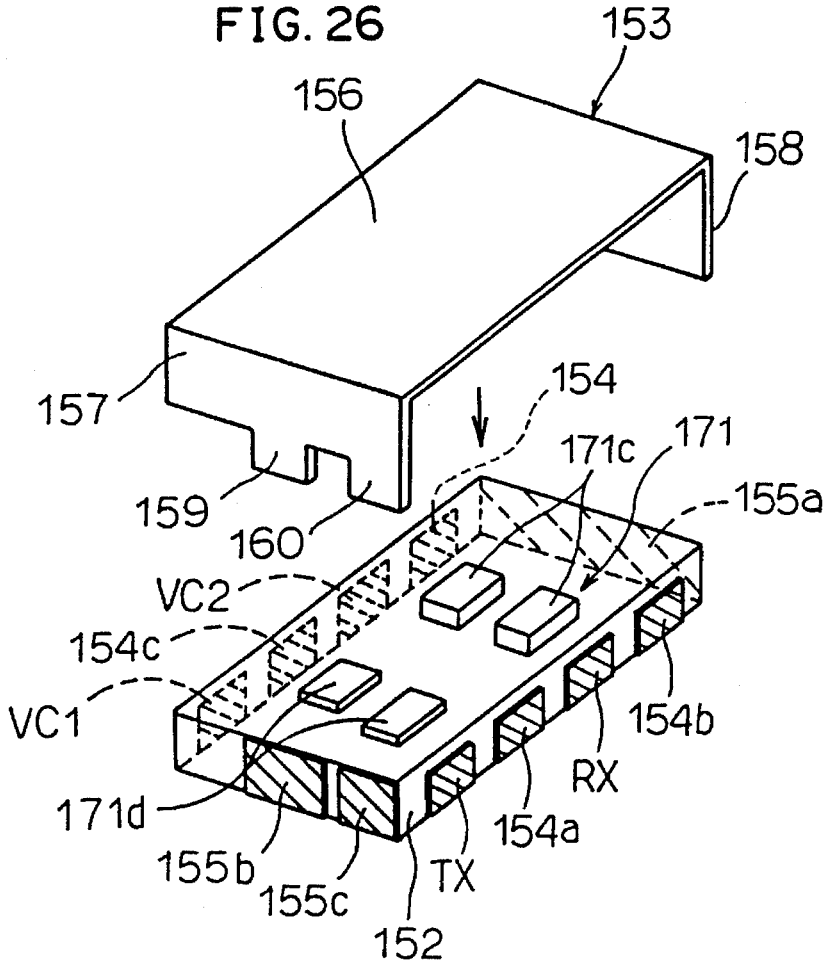
FIG. 26 is an exploded perspective view showing the antenna unit according to the fourth embodiment of the present invention.

FIG. 25 is a perspective view showing the appearance of the antenna unit 151 according to the fourth embodiment of the present invention, and FIG. 26 is an exploded perspective view thereof.

In the antenna unit 151, a radiator 153 is fixed to a dielectric substrate 152.

The dielectric substrate 152 has a multilayer structure of ceramics or synthetic resin, which is in the form of a rectangular parallelepiped as a whole as shown in FIGS. 25 and 26. The dielectric substrate 152 is provided on both longer side surfaces with a transmission input electrode TX, a receiving output electrode RX and control input electrodes VC1 and VC2 of the antenna switching circuit 171 and a plurality of ground electrodes 154*a* to 154*d*, as internal electrodes. Further, connecting electrodes 155*a* to 155*c* are formed on both shorter side surfaces of the dielectric substrate 152.

Figure 27:
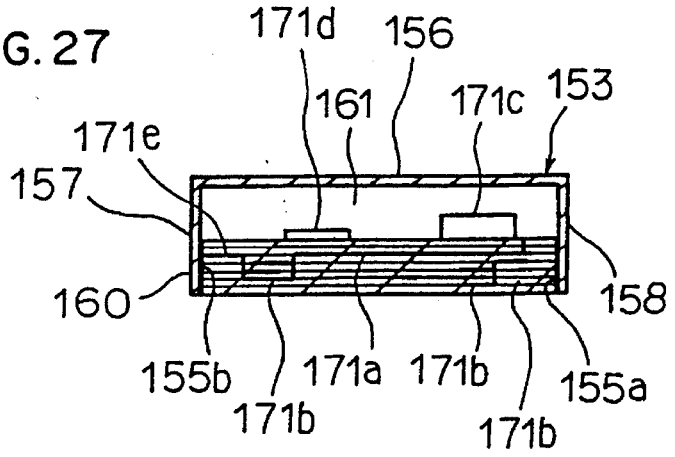
FIG. 27 is a surface sectional view for illustrating a structure in a dielectric substrate of the antenna unit according to the fourth embodiment of the present invention.

The dielectric substrate 152 is further provided with circuit elements such as a stripline 171*a* and capacitors 171*b* which are formed in its interior and diodes 171*c* and resistances 171*d* which are formed on its surface by printing, as shown in FIG. 27. The antenna switching circuit 171 is formed by these circuit elements. An antenna output electrode 171*e* of the antenna switching circuit 171 is connected from the interior of the dielectric substrate 152 to the connecting electrode 155*b* provided on its side surface, and the respective circuit elements are electrically connected to the internal electrodes or via holes (schematically illustrated).

The radiator 153, which is made of a material having low conductor loss Such as a metal such as copper or a copper alloy, for example, is formed by bending a metal plate by machining. This radiator 153 comprises a radiating part 156 having a rectangular plane shape, and first and second fixed parts 157 and 158 which are formed by bending both shorter sides of the radiating part 156 respectively. The first and second fixed parts 157 and 158 are fixed similarly to the first and second fixed parts 57 and 58 of the antenna unit 51 according to the second embodiment. Further, a feed terminal 159 and a ground terminal 160 are integrally formed on a forward end of the first fixed part 157. The first fixed part 157 is shorter than the second fixed part 158 by a length corresponding to those of the feed terminal 159 and the ground terminal 160. In other words, lower ends of the feed terminal 159 and the ground terminal 160 are flush with a lower end of the second fixed part 158. The length between the radiating part 156 and the feed terminal 159, the ground terminal 160 or the lower end of the second fixed part 158 is set to be larger than the thickness of the dielectric substrate 152.

In assembling the antenna unit 151, the dielectric substrate 152 inserted in the radiator 153 so that the shorter side surfaces of the dielectric substrate 152 are in contact with inner surfaces of the first and second fixed parts 157 and 158 respectively. The feed terminal 159 and the ground terminal 160 are bonded to the connecting electrodes **155*b* and 155*c* by solder while the second fixed part 158 is bonded to the connecting electrode 155*a* by solder, thereby obtaining the antenna unit 151. In this case, the radiator 153 is so bonded to the dielectric subs rate 152 that a space 161 of a prescribed thickness is formed between the lower surface of the radiating part 156 and the upper surface of the dielectric substrate 152, as shown in FIG. 27**.

According to this embodiment, the lengths of the first and second fixed parts 157 and 158, i.e., dimensions in the direction toward the dielectric substrate 152, and the thickness of the dielectric substrate 152 are set in the aforementioned relation, whereby it is possible to reliably form the aforementioned space 161 by covering the dielectric substrate 152, which is placed on a flat surface, with the radiator 153 from above and bringing the lower surfaces of the feed terminal 159, the ground terminal 160 and the second fixed part 158 into contact with the flat surface.

Figure 28:
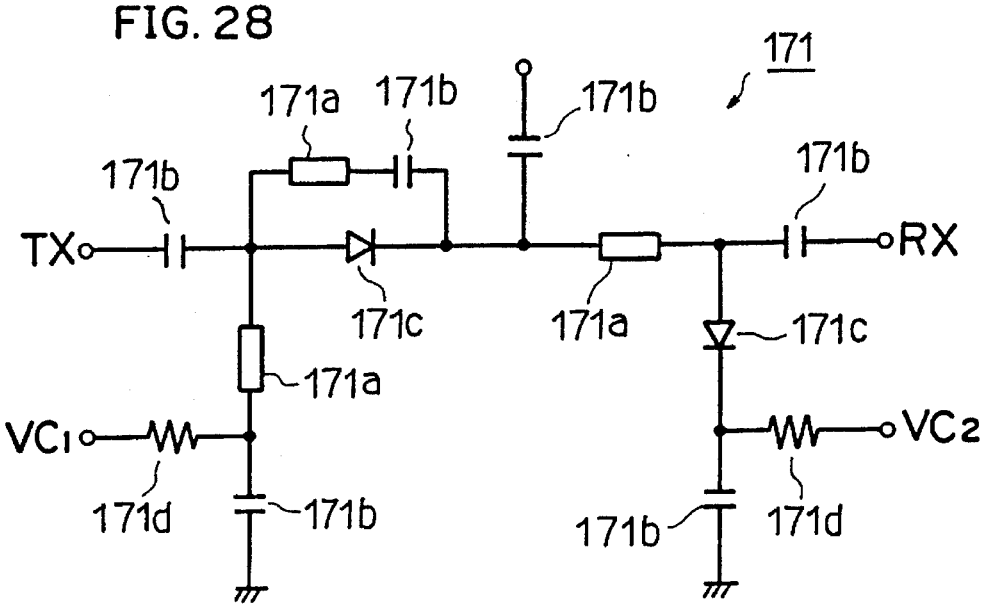
FIG. 28 illustrates a circuit structure of an antenna switching circuit stored in the antenna unit according to the fourth embodiment of the present invention.
Figure 29:
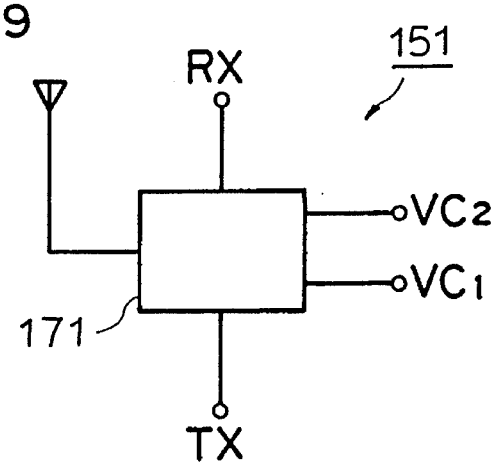
FIG. 29 is a schematic block diagram for illustrating a method of electrical connection for driving the antenna unit according to the fourth embodiment of the present invention.

FIG. 28 shows a concrete example of the antenna switching circuit 71 which is enclosed in the antenna unit 151 according to this embodiment. FIG. 29 is a schematic block diagram of the antenna unit 151.

The antenna switching circuit 171 shown in FIG. 28 is merely an example of that enclosed in the antenna unit 151 according to this embodiment. Alternatively, the antenna unit 151 can appropriately enclose an antenna switching circuit which is well known in the art or the like.

It is possible to surface-mount the antenna unit 151 on a printed circuit board (not shown) which is provided on its upper surface with interconnection patterns, by placing the same on the printed circuit board and soldering the transmission input electrode TX, the receiving output electrode RX, the control input electrodes VC1 and VC2, the ground electrodes **154*a* and 154*b* and the ground terminal 160 to the respective interconnection patterns. A signal flows between the antenna switching circuit 171 and the radiating part 156 through the feed terminal 159 of the radiator 153, so that the radiating part 156** transmits/receives electric waves.

In the antenna unit 151 according to this embodiment, the respective circuit elements forming the antenna switching circuit 171 are formed in the interior of the dielectric substrate 152 and in the space 161 which is formed between the upper surface of the dielectric substrate 152 and the radiating part 156, whereby the dielectric substrate 152 can be provided with a flat bottom surface. Further, it is possible to easily surface-mount the antenna unit 151 including the aforementioned antenna switching circuit 171 on a printed circuit board since the transmission input electrode TX, the receiving output electrode RX, the control input electrode VC1 and VC2, the ground electrodes **154*a* and 154*b* and the ground terminal 160 are formed on the side surfaces of the antenna unit 151** as external electrodes.

Figure 30:
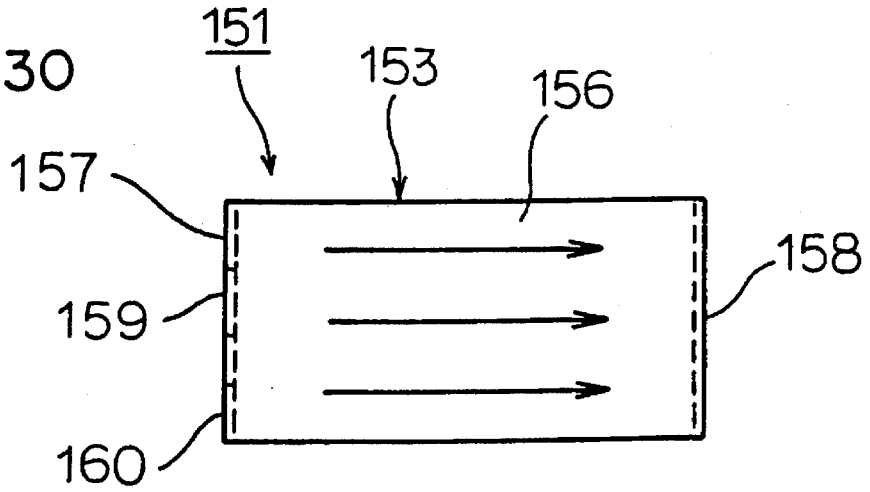
FIG. 30 is a plan view showing the direction of a high-frequency current flowing in a radiating part in the antenna unit according to the fourth embodiment of the present invention.

In this antenna unit 151, a high-frequency current flows in the radiating part 156 of the radiator 153 as shown by arrows in a schematic plan view of FIG. 30. Namely, the high-frequency current flows from the feed terminal 159 toward the side surface which is opposed to that provided with the feed terminal 159, so that a magnetic field is developed around this high-frequency current. Thus, an electric field is developed around the magnetic field, so that the radiating part 156 radiates electric waves. At this time, an overcurrent which is developed on the ground surface by the aforementioned magnetic field is suppressed due to the space 161 provided between the radiating part 156 of the radiator 153 and the surface of the dielectric substrate 152. In addition, the electric field concentrates very little in the interior of the dielectric substrate 152. Thus, radiation efficiency for the electric waves is improved, thereby effectively improving the gain of the antenna unit 151. Consequently, it is possible to ensure a sufficient gain even when the antenna unit 151 is reduced in size.

Further, the radiating part 156 for transmitting/receiving electric waves is made of the aforementioned metal material as a member of low conductor loss, whereby the antenna unit 151 is reduced in electrical resistance and increased in thermal capacity. Thus, joule loss is reduced to also improve the gain of the antenna unit 151.

Figure 31:
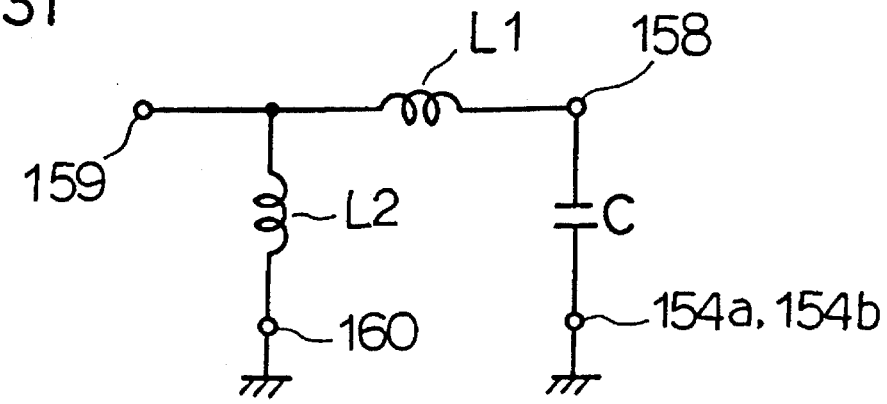
FIG. 31 illustrates an equivalent circuit of an antenna part of the antenna unit according to the fourth embodiment of the present invention.

FIG. 31 shows an equivalent circuit of an antenna part of the aforementioned antenna unit 151. This equivalent circuit is similar to that of the antenna unit 31 according to the first embodiment shown in FIG. 6. Therefore, corresponding portions are denoted by corresponding reference numerals, to omit redundant description.

Figure 32:
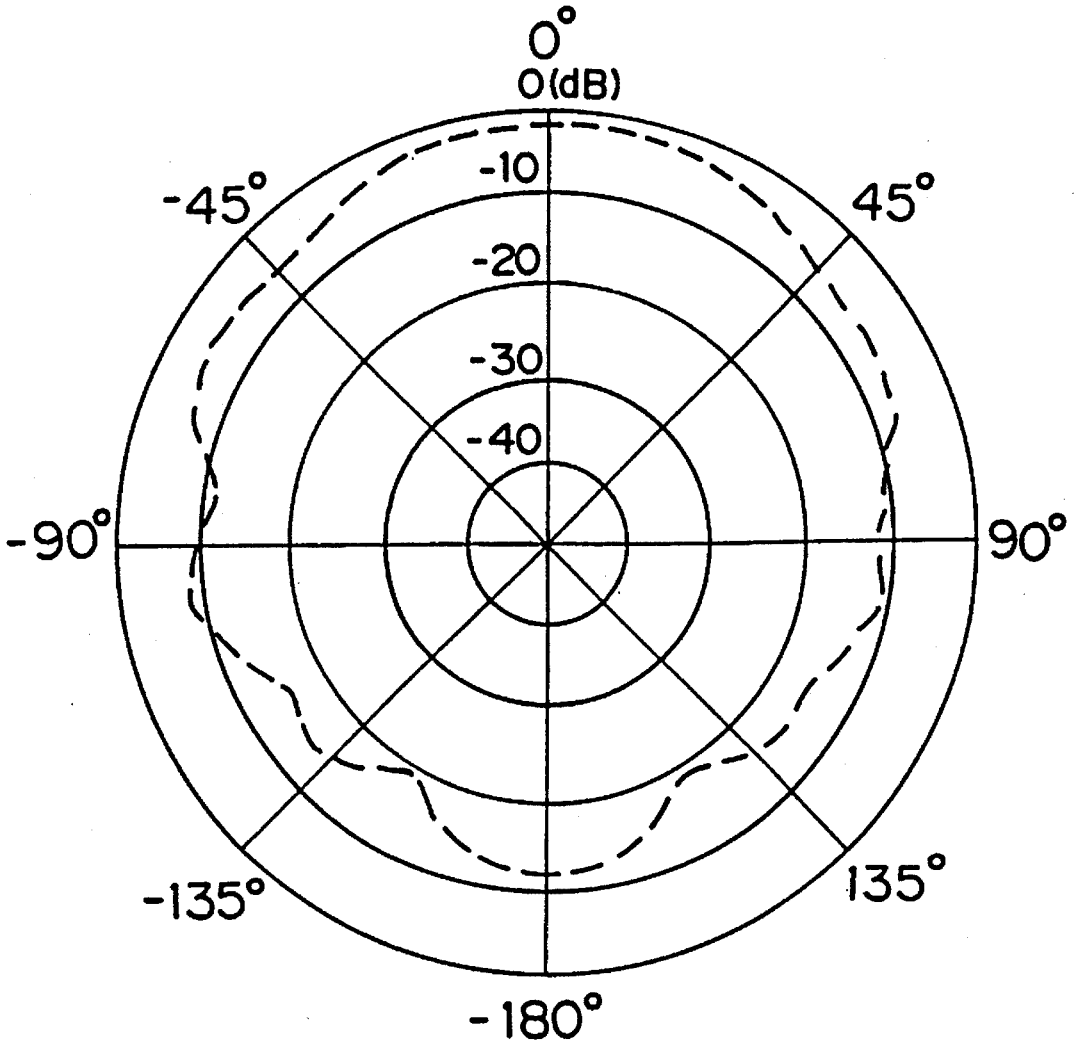
FIG. 32 illustrates a directional pattern of the antenna unit according to the fourth embodiment of the present invention.

A sample of the aforementioned antenna unit 151 was prepared in a length of 10 mm, a width of 6.3 mm and a height of 4 mm with a resonance frequency of 1.9 GHz, and subjected to measurement of a directional pattern. FIG. 32 shows the result. Referring to FIG. 32, this sample has an excellent maximum gain of −2 dB and the aforementioned size is about 1/16 of the wavelength of electric waves as transmitted/received in the largest portion. Thus, it is understood that the antenna unit 181 can be remarkably miniaturized as compared with the conventional antenna unit.

Also in this embodiment, it is possible to easily adjust the resonance frequency of the antenna unit 151 by changing the distances between the ground electrodes **154*a* and 154*b* which are provided on the dielectric substrate 152 and the fixed parts 157 and 158 of the radiator 153 or the surface areas of the ground electrodes 154*a* and 154*b* and the connecting electrode 155*a* thereby changing floating capacitance between the ground electrodes 154*a* and 154*b* and the fixed part 158**.

While the antenna unit 151 according to this embodiment includes the antenna switching circuit 171, the dielectric substrate 152 may alternatively enclose or carry another peripheral circuit such as a surface-wave filter, a low-pass filter, a diplexer or a high-frequency amplifier.

[Fifth Embodiment]

Figure 33:
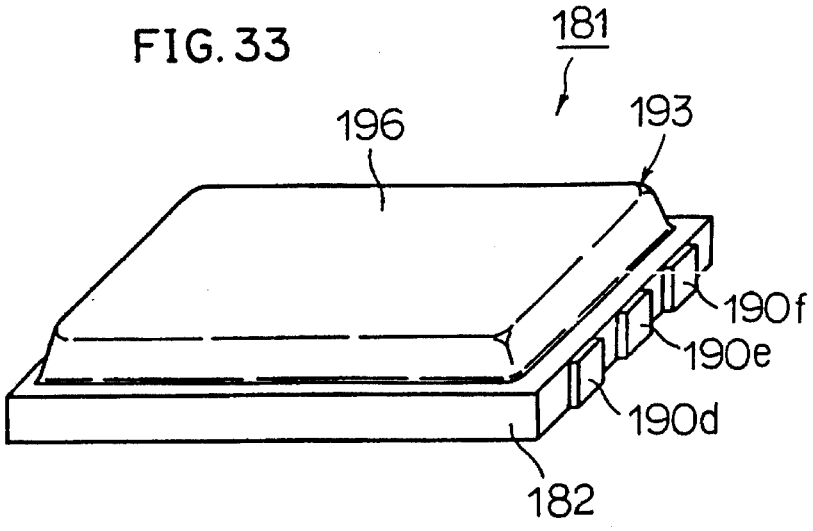
FIG. 33 is a perspective view showing an antenna unit according to a fifth embodiment of the present invention.

FIG. 33 is a perspective view showing an antenna unit 181 according to a fifth embodiment of the present invention.

This antenna unit 181 has a dielectric substrate 182 and a radiator 193.

Figure 34:
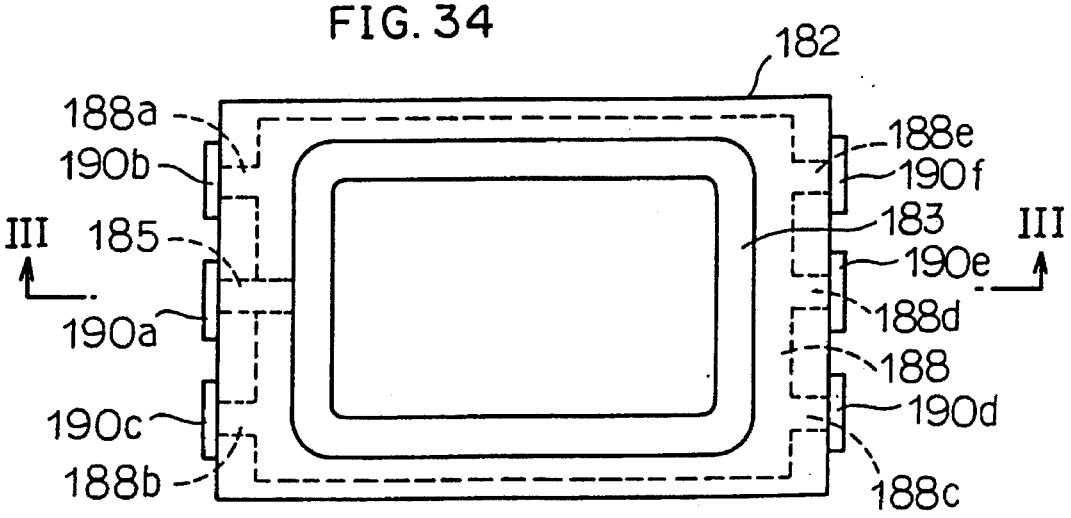
FIG. 34 is a plan view showing a dielectric substrate employed in the antenna unit according to the fifth embodiment of the present invention.
Figure 35:
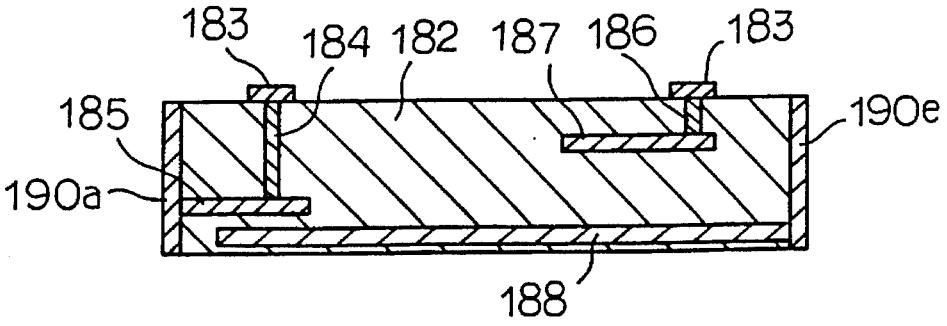
FIG. 35 is a sectional view taken along the line III—III in FIG. 34, showing the dielectric substrate employed in the antenna unit according to the fifth embodiment of the present invention.

FIG. 34 is a plan view showing the dielectric substrate 182, and FIG. 35 is a sectional view taken along the line III—III in FIG. 34.

A mounting electrode 183 is formed on an upper surface of the dielectric substrate 182. This mounting electrode 183 is annularly formed along inner sides of a peripheral edge portion of the dielectric substrate 182, for example.

In a portion close to an end of the dielectric substrate 182, a via hole 184 is formed under the mounting electrode 183. The via hole 184 is formed to extend along the thickness of the dielectric substrate 182. A first internal electrode 185 is formed under the via hole 184. The first internal electrode 185 is formed in the interior of the dielectric substrate 182 in parallel with a first major surface of the dielectric substrate 182, at a prescribed distance from the first major surface. An en( of the first internal electrode 185 is drawn out on a side surface of the dielectric substrate 182, so that the mounting electrode 183 and the internal electrode 185 are electrically connected with each other by a conductive material which is charged in the via hole 184.

In a portion close to the other end of the dielectric substrate 182, on the other hand, another via hole 186 is formed under the mounting electrode 183. A second internal electrode 187 is formed to be connected to a lower end of the via hole 186. The second internal electrode 187 is formed in the interior of the dielectric substrate 182 in parallel with the first major surface of the dielectric substrate 182. The mounting electrode 183 and the second internal electrode 187 are electrically connected with each other by a conductive material which is charged in the via hole 188.

A shield electrode 188 is formed in the dielectric substrate 182. This shield electrode 188 is formed downward beyond the first and second internal electrodes 185 and 187, substantially over an inner surface of the dielectric substrate 182 which is in parallel with the major surface. The shield electrode 188 is provided with a plurality of electrode drawing parts 188*a* to 188*e*. The electrode drawing parts 188*a* and 188*b* are drawn out on the side surface of the dielectric substrate 182 on which the first internal electrode 185 is drawn out. On the other hand, the electrode drawing parts 188*c* to 188*e* are drawn out on a side surface of the dielectric substrate 182 which is opposite to that on which the first internal electrode 185 is drawn out.

A plurality of external electrodes 190*a* to 190*f* are formed on the side surfaces of the dielectric substrate 182. Among these external electrodes 190*a* to 190*f*, the external electrode 190*a* is formed to be electrically connected with the first internal electrode 185. The remaining external electrodes 190*b* to 190*f* are formed to be electrically connected with the electrode drawing parts 188*a* to 188*e*.

The external electrode 190*a* is employed as a feeding point, and the remaining external electrodes 190*b* to 190*f* are connected to the ground potential.

Figure 36A:
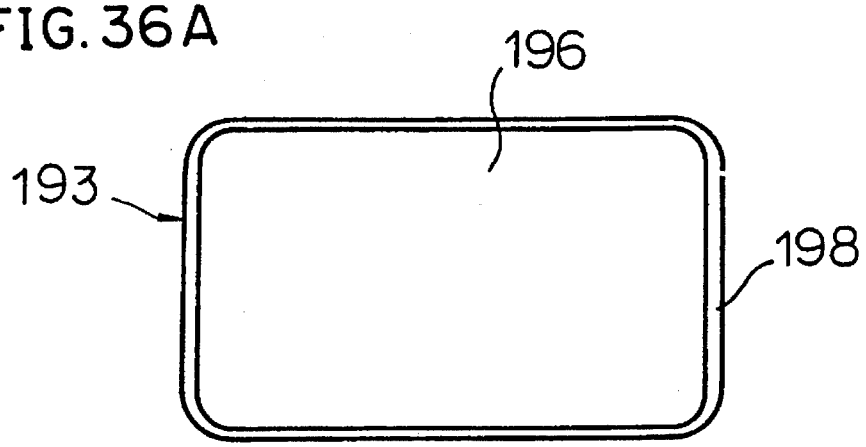
FIGS. 36A and 36B are a plan view and a front elevational view showing a radiator employed in the antenna unit according to the fifth embodiment of the present invention.
Figure 36B:
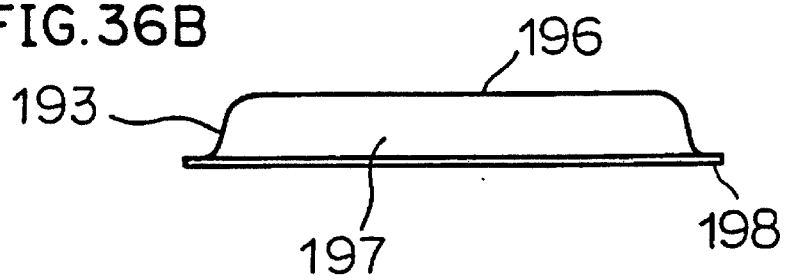

The antenna unit 181 according to this embodiment has a radiator 193 which is shown in FIGS. 36A and 36B in a plan view and a side elevational view respectively. The radiator 193 is mounted to cover the upper surface of the dielectric substrate 182, to be bonded to the mounting electrode 183 by solder, for example, and electrically connected thereto.

The radiator 193 comprises a radiating part 196 having a substantially rectangular plane shape, and an annular side wall portion 197 downwardly extends from the periphery of the radiating part 196. A flange part 198 is formed on another end of the annular side wall part 197. This flange part 198 extends in parallel with the radiating part 196 as well as the major surface of the dielectric substrate 182. The flange part 198 is bonded to the mounting electrode 183 by soldering.

The radiator 193 forms a transmission/receiving part of the antenna unit 181 according to this embodiment. Thus, the antenna unit 181 is formed by the dielectric substrate 182, the external electrodes 190*a* to 190*f* and the radiator 193.

Figure 37:
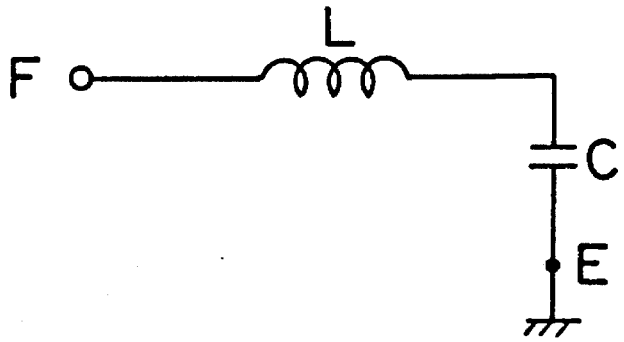
FIG. 37 illustrates an equivalent circuit of the antenna unit according to the fifth embodiment of the present invention.

FIG. 37 shows an equivalent circuit of the antenna unit 181 according to this embodiment. Referring to FIG. 37, symbol F denotes a feeding point, and symbol E denotes an earth terminal. The antenna unit 181 includes an inductance L and a capacitance C. The inductance L is formed by a distributed inductance component of the radiator 193. The capacitance C is formed by electrostatic capacitance which is developed across the second internal electrode 187 and the shield electrode 188 provided in the interior of the dielectric substrate 182.

It is possible to connect the antenna unit 181 according to the fifth embodiment of the present invention with an external circuit through the external electrodes 190*a* to 190*f*. Thus, the dielectric substrate 182 has a flat lower surface, whereby the antenna unit 181 can be surface-mounted. Further, a capacitor is formed by the second internal electrode 187 and the shield electrode 188, whereby electrode spacing for obtaining capacitance can be reduced and higher electrostatic capacitance can be obtained as compared with the conventional microstrip antenna. Consequently, it is possible to reduce the inductance component, thereby miniaturizing the radiator 193 for obtaining the inductance component. Thus, it is possible to reduce the length of the antenna unit 181 to about 1/13 of the wavelength of the electric waves as transmitted/received in the case of a resonance frequency of 1.8 GHz, for example, thereby facilitating miniaturization.

In the antenna unit 181 according to this embodiment, further, electrical resistance is reduced and thermal capacitance is increased since the electric wave transmission/receiving part is formed by the radiator 193 of a metal, whereby joule loss is reduced.

Figure 38:
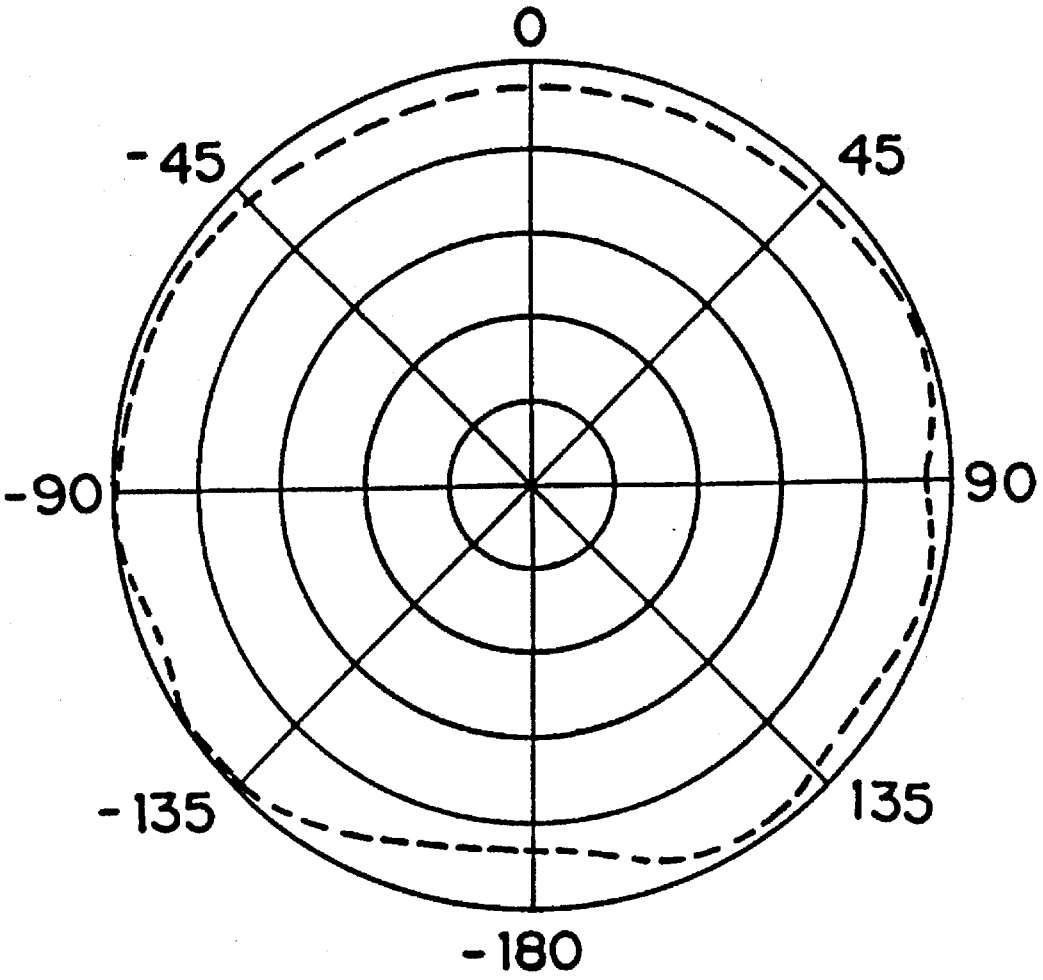
FIG. 38 illustrates a directional pattern of the antenna unit according to the fifth embodiment of the present invention.

FIG. 38 shows an exemplary directional pattern of the antenna unit 181 according to the fifth embodiment. As clearly understood from FIG. 38, the antenna unit 181 according to this embodiment is omnidirectional and can be preferably applied to a mobile communication device.

Figure 39A:
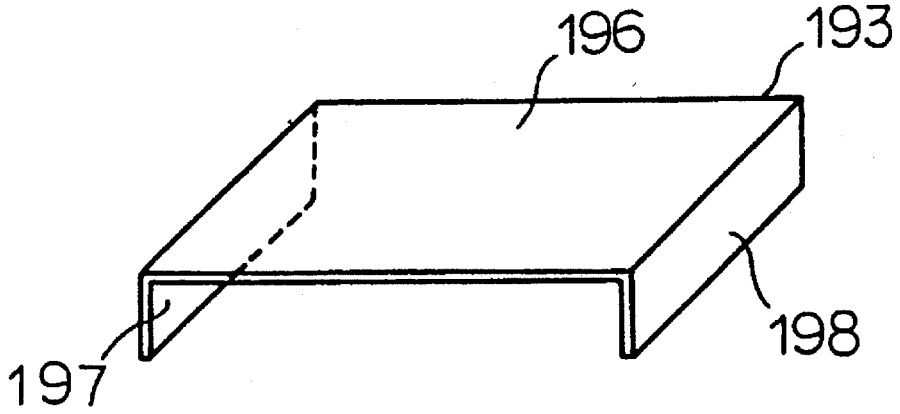
FIGS. 39A to 39C are perspective views showing modifications of the radiator employed in the antenna unit according to the fifth embodiment of the present invention respectively.
Figure 39B:
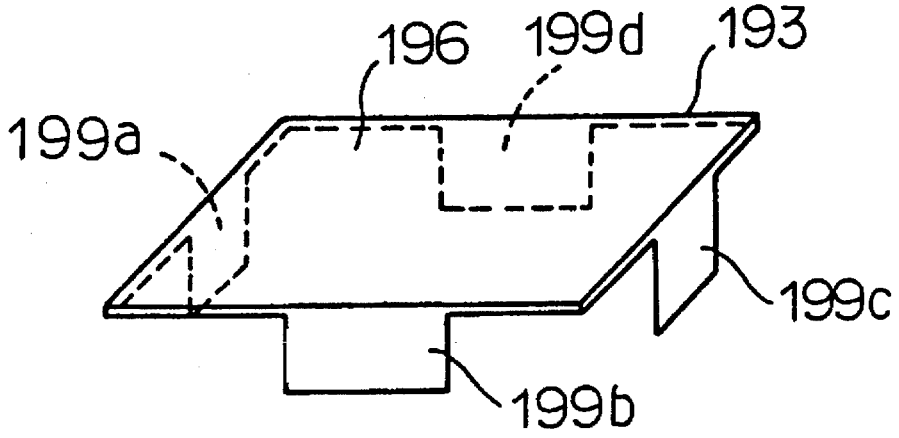
Figure 39C:
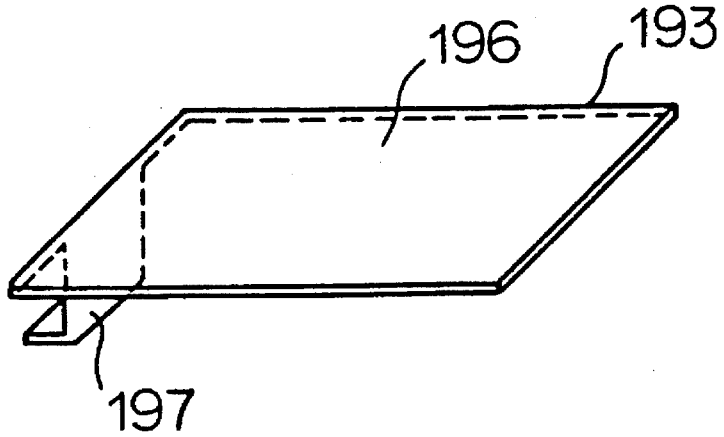

FIGS. 39A to 39C show modifications of the aforementioned radiator 193. In a radiator 193 shown in FIG. 39, an opposite pair of sides of a radiating part 196 having a rectangular plane shape are bent to form fixed parts 197 and 198 respectively. In a radiator 193 shown in FIG. 39B, on the other hand substantially central portions of four sides of a radiating part 196 having a rectangular plane shape are downwardly bent to form strip-shaped first to fourth fixed parts 199*a* to 199*d*. In a radiator 193 shown in FIG. 39C, further, a substantially central portion of one side of a radiating part 196 having a rectangular plane shape is bent to form a fixed part 197 having a L-shaped section.

Also when the radiators 193 shown in FIGS. 39A to 39C are employed, it is possible to attain functions/effects which are similar to those of the antenna unit 151 according to the fifth embodiment.

Figure 40A:
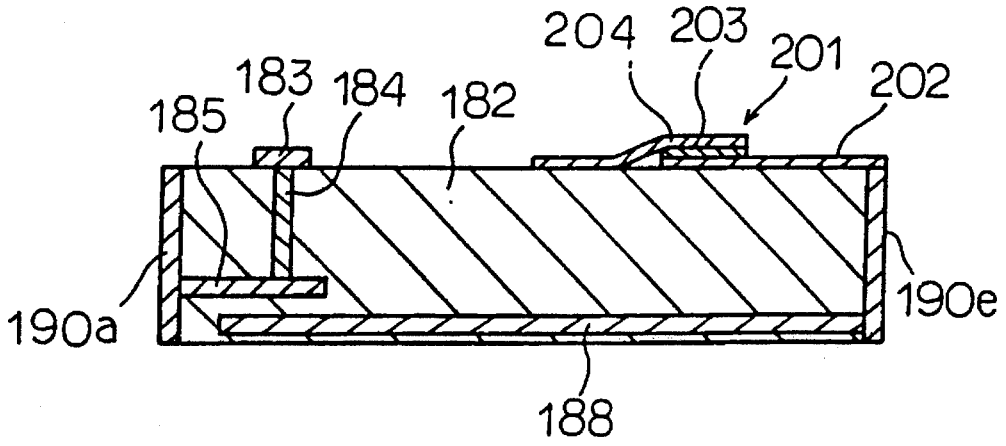
FIGS. 40A to 40C are longitudinal sectional views showing internal structures of dielectric substrates employed for the antenna unit according to the fifth embodiment respectively.
Figure 40B:
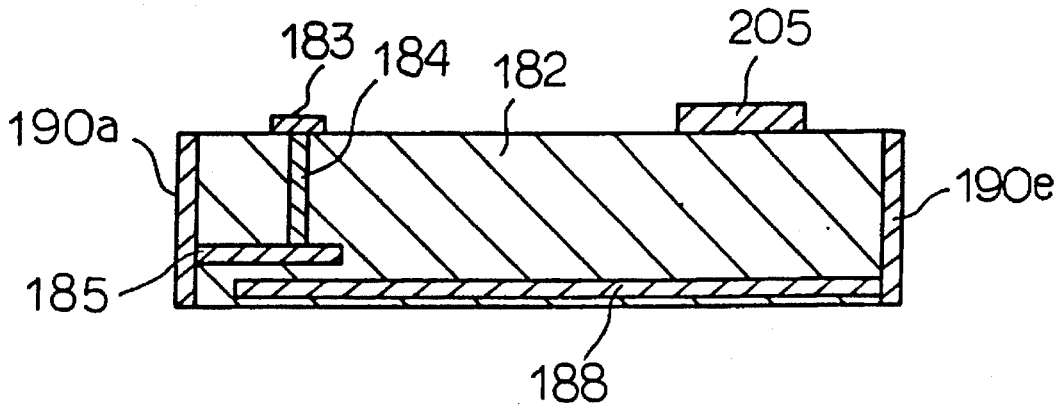
Figure 40C:
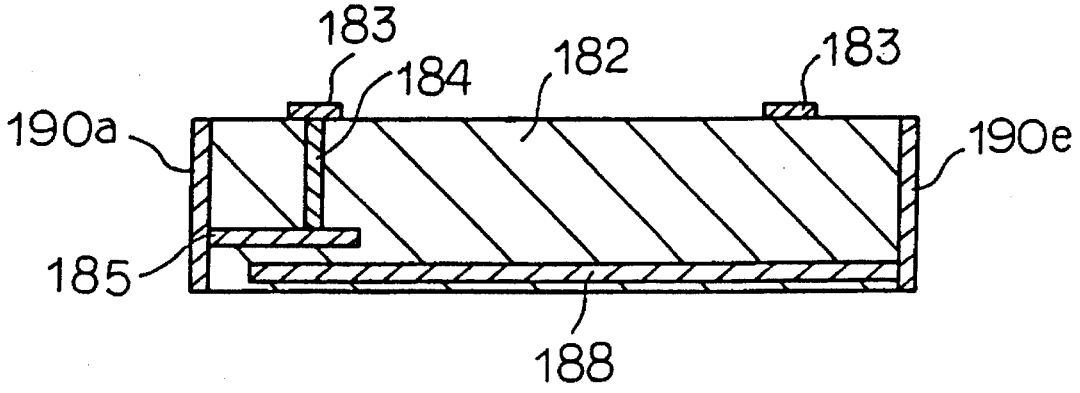

FIGS. 40A to 40C are sectional views showing modifications of the dielectric substrate 182 employed in the antenna unit 151 according to the fifth embodiment respectively.

In a dielectric substrate 182 shown in FIG. 40A, a capacitor 201 is formed on an upper surface which is provided with a mounting electrode 183, in place of the aforementioned second internal electrode 187. This capacitor 201 includes a first electrode film 202. The first electrode film 202 is formed by a method such as printing, for example, so that an end thereof is electrically connected to at least one of external electrodes 190*b* to 190*f* which are formed on the dielectric substrate 182. On another end of the first electrode film 202, a dielectric film 203 is formed on the upper surface of the electrode film 202. Further, a second electrode film 204 is formed on the upper surface of the dielectric film 203. An end of the second electrode film 204 is connected to the mounting electrode 183.

Due to the capacitor 201 having the aforementioned structure, it is possible to increase the capacitance C of the antenna unit 181 according to the fifth embodiment, thereby reducing the resonance frequency and facilitating miniaturization of the antenna unit 181.

In the modification shown in FIG. 40B, a chip-type capacitor 205 is mounted on an upper surface of a dielectric substrate 182, in place of the second internal electrode 187 formed in the interior of the dielectric substrate 182. A first electrode of the chip-type capacitor 205 is connected to at least one of external electrodes 190*b* to 190*f* which are formed on the dielectric substrate 182, while a second electrode thereof is electrically connected to a mounting electrode 183 which is formed on the dielectric substrate 182.

A dielectric substrate 182 shown in FIG. 40C is not provided with a second internal electrode such as electrode 187 shown in FIG. 35. When the dielectric substrate 182 shown in FIG. 40C is employed, the capacitance C of the equivalent circuit shown in FIG. 37 is formed by distributed capacitance developed in a radiator 13 and other electrode portions. This structure is suitably applied to a higher frequency use.

In every one of the aforementioned embodiments and modifications, the dielectric substrate and the radiator can be bonded with each other by a bonding material other than solder, such as an adhesive or silver solder, for example. Further, the dielectric substrate may alternatively be in the form of a cube, while the radiating part of the radiator may alternatively have a square plane shape.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A surface-mountable antenna unit comprising:

a dielectric substrate having a top surface, a substantially flat bottom surface for surface-mounting, and side surfaces;

a ground electrode being formed on at least one of a side surface and a bottom surface of said dielectric substrate;

a radiator, having a major surface and consisting of a material having low conductor loss, being fixed to said dielectric substrate so that its major surface is opposed to the top surface of said dielectric substrate, to thereby form a laminate of said dielectric substrate and said radiator; and a feed part being provided at least on one of a side surface and a bottom surface of said laminate formed by said dielectric substrate and said radiator wherein said radiator comprises a radiating part having said major surface, and at least one fixed part extending from at least one edge of said radiating part toward said dielectric substrate, said at least one fixed part being fixed to said side surface of said dielectric substrate, thereby fixing said radiator to said dielectric substrate, and further comprising a feed terminal and a ground terminal being integrally formed on said at least one fixed part of said radiator.

2. A surface-mountable antenna unit in accordance with claim 1, wherein said major surface of said radiator is in contact with said top surface of said dielectric substrate.

3. A surface-mountable antenna unit in accordance with claim 1, wherein said major surface of said radiator is spaced from said top surface of said dielectric substrate by a prescribed distance.

4. A surface-mountable antenna unit in accordance with claim 3, further comprising a dielectric layer being arranged in a space between said major surface of said radiating part and said top surface of said dielectric substrate.

5. A surface-mountable antenna unit in accordance with claim 4, wherein said dielectric layer is arranged to fill up said space.

6. A surface-mountable antenna unit in accordance with claim 4, further comprising a circuit element being arranged on said dielectric substrate in a space between said major surface of said radiating part and said top surface of said dielectric substrate.

7. A surface-mountable antenna unit in accordance with claim 6, further comprising a circuit element being stored in said dielectric substrate.

8. A surface-mountable antenna unit in accordance with claim 1, wherein said feed terminal serving as said feed part is integrally formed on a forward end of one said fixed part.

9. A surface-mountable antenna unit in accordance with claim 1, Wherein said radiating part has a rectangular plane shape being provided with longer and shorter sides, said feed terminal and said ground terminal being arranged on the same said side of said radiating part.

10. A surface-mountable antenna unit in accordance with claim 9, wherein said feed terminal and said ground terminal are arranged on said longer side of said radiating part.

11. A surface-mountable antenna unit in accordance with claim 9, wherein said feed terminal and said ground terminal are arranged on said shorter side of said radiating part.

12. A surface-mountable antenna unit in accordance with claim 1, wherein said radiating part has a rectangular plane shape being provided with longer and shorter sides, said feed terminal and said ground terminal being arranged on different said sides of said radiating part.

13. A surface-mountable antenna unit in accordance with claim 1, further comprising a capacitor being electrically connected between said ground electrode and said radiating part.

14. A surface-mountable antenna unit in accordance with claim 13, comprising a capacitor electrode being formed in said dielectric substrate and a ground electrode being arranged to overlap With said capacitor electrode through a dielectric substrate layer, said capacitor being formed by said capacitor electrode and said ground electrode.

15. A surface-mountable antenna unit in accordance with claim 13, wherein said capacitor is formed by a capacitor element being carried on said top surface of said dielectric substrate.

16. A surface-mountable antenna unit in accordance with claim 13, wherein said capacitor is formed by a pair of capacitor electrodes being formed on said top surface of said dielectric substrate at a prescribed distance and a dielectric layer being connected between said capacitor electrodes.

17. A surface-mountable antenna unit in accordance with claim 13, wherein said capacitor is formed by an electrode being formed on said top surface of said dielectric substrate and a ground electrode being formed in said dielectric substrate.

18. A surface-mountable antenna unit in accordance with claim 1, further comprising space holding means for spacing said first major surface of said radiating part of said radiator away from said top surface of said dielectric substrate by a prescribed thickness.

19. A surface-mountable antenna unit in accordance with claim 18, wherein said space holding means is formed by a stop member extending from an edge of said radiating part toward said top surface of said dielectric substrate and being formed on said top surface of said dielectric substrate.

20. A surface-mountable antenna unit in accordance with claim 19, wherein said radiating part has a rectangular plane shape, said stop member being formed on a side being different from that provided with said fixed part.

21. A surface-mountable antenna unit in accordance with claim 19, wherein said radiating part has a rectangular plane shape, said stop member being formed on the same said side as that provided with said fixed part.

22. A surface-mountable antenna unit in accordance with claim 21, wherein a pair of stop members are arranged on both sides of at least one said fixed part, forward ends of said pair of stop members being in contact with said top surface of said dielectric substrate.

23. A surface-mountable antenna unit in accordance with claim 19, wherein a stop surface part extending in parallel with said top surface of said dielectric substrate is formed on a forward end of said stop member, said stop surface part being in contact with said top surface of said dielectric substrate.

24. A surface-mountable antenna unit in accordance with claim 18, wherein said radiator has a radiating part and a side wall part being provided around said radiating part in the form of a closed ring, and a flange part is formed on a forward end of said side wall part, said flange part being fixed to said top surface of said dielectric substrate thereby forming said space holding means.

25. A surface-mountable antenna unit in accordance with claim 18, wherein said space holding means is formed by a projection being on said top surface of said dielectric substrate so that its forward end is in contact with said radiating part.

26. A surface-mountable antenna unit in accordance with claim 25, wherein said projection is defined by first and second strip-shaped projections being arranged along a pair of edges of said dielectric substrate.

27. A surface-mountable antenna unit in accordance with claim 25, wherein said projection is an annular projection being formed on said top surface of said dielectric substrate so that its forward end surface is in contact with said radiating part.

28. A surface-mountable antenna unit in accordance with claim 25, wherein a plurality of said projections are formed on said top surface of said dielectric substrate at prescribed distances.

29. A surface-mountable antenna unit in accordance with claim 1, further comprising a circuit element being enclosed in said dielectric substrate.

30. A surface-mountable antenna unit in accordance with claim 1, wherein said radiator is formed by a metal plate.

31. A surface-mountable antenna unit in accordance with claim 1, wherein said major surface of said radiating part of said radiator is superposed on said first major surface of said dielectric substrate.

32. A surface-mountable antenna unit in accordance with claim 31, wherein a feed terminal serving as said feed part is integrally formed on a forward end of one said fixed part.

33. A surface-mountable antenna unit in accordance with claim 31, further comprising a feed terminal and a ground terminal being integrally formed on forward end or ends of identical or different said fixed parts.

34. A surface-mountable antenna unit in accordance with claim 33, wherein said radiating part has a rectangular plane shape being provided with longer and shorter sides, said feed terminal and said ground terminal being arranged on the same said side of said radiating part.

35. A surface-mountable antenna unit in accordance with claim 34, wherein said radiating part has a rectangular plane shape being provided with longer and shorter sides, said feed terminal and said ground terminal being arranged on said longer side of said radiating part.

36. A surface-mountable antenna unit in accordance with claim 34, wherein said feed terminal and said ground terminal are arranged on said shorter side of said radiating part.

37. A surface-mountable antenna unit in accordance with claim 33, wherein said radiating part has a rectangular plane shape being provided with longer and shorter sides, said feed terminal and said ground terminal being arranged on different said sides of said radiating part.

38. A surface-mountable antenna unit in accordance with claim 31, further comprising a capacitor being electrically connected between said ground electrode and said radiating part.

39. A surface-mountable antenna unit in accordance with claim 38, further comprising a capacitor electrode being formed in said dielectric substrate, and a ground electrode being arranged to overlap with said capacitor electrode through a dielectric substrate layer, said capacitor being formed by said capacitor electrode and said ground electrode.

40. A surface-mountable antenna unit in accordance with claim 31, further comprising a circuit element being enclosed in said dielectric substrate.

41. A surface-mountable antenna unit in accordance with claim 31, wherein said radiator is formed by a metal plate.

42. A surface-mountable antenna unit comprising:

a dielectric substrate having a top surfacer a bottom surface and side surfaces;

a ground electrode being formed on at least one of a side surface and a bottom surface of said dielectric substrate;

a radiator, having a major surface and consisting of a material having low conductor loss, being fixed to said dielectric substrate so that its major surface is opposed to the top surface of said dielectric substrate; and a feed part being provided at least on one of a side surface and a bottom surface of a laminate formed by said dielectric substrate and said radiator;

further comprising a shield electrode being formed on said dielectric substrate, said shield electrode being electrically connected to said ground electrode, and said radiator has a radiating part and an annular side wall part extending from an edge of said radiating part toward said dielectric substrate, a flange part being formed on a forward end of said annular side wall part, said flange part being electrically connected to and mechanically bonded with said shield electrode, thereby defining a space of a prescribed thickness between said radiating part and said dielectric substrate.

43. A surface-mountable antenna unit in accordance with claim 42, wherein said shield electrode and said ground electrode being formed on said side surface of said dielectric substrate are electrically connected with each other by a via hole electrode being formed in said dielectric substrate.

44. A surface-mountable antenna unit in accordance with claim 42, further comprising a capacitor being electrically connected between said ground electrode and said radiator.

45. A surface-mountable antenna unit in accordance with claim 42, comprising a capacitor electrode being formed in said dielectric substrate, and a ground electrode being arranged to overlap with said capacitor electrode through a dielectric substrate layer, said capacitor being formed by said capacitor electrode and said ground electrode.

46. A surface-mountable antenna unit in accordance with claim 42, wherein said capacitor is formed by a pair of capacitor electrodes being formed on said first major surface of said dielectric substrate at a prescribed distance.

47. A surface-mountable antenna unit in accordance with claim 42, wherein said capacitor is formed by an electrode being formed on said top surface of said dielectric substrate and a ground electrode being formed in said dielectric substrate.

* * * * *